US009899770B2

(12) United States Patent
Yoshida

(10) Patent No.: US 9,899,770 B2
(45) Date of Patent: Feb. 20, 2018

(54) LEVER-TYPE CONNECTOR

(71) Applicant: Yazaki Corporation, Tokyo (JP)

(72) Inventor: Kosuke Yoshida, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/447,338

(22) Filed: Mar. 2, 2017

(65) Prior Publication Data

US 2017/0256889 A1 Sep. 7, 2017

(30) Foreign Application Priority Data

Mar. 4, 2016 (JP) ..... 2016-041842

(51) Int. Cl.
*H01R 13/62* (2006.01)
*H01R 13/629* (2006.01)
*H01R 13/627* (2006.01)
*H01R 43/20* (2006.01)

(52) U.S. Cl.
CPC ... *H01R 13/62977* (2013.01); *H01R 13/6275* (2013.01); *H01R 43/20* (2013.01)

(58) Field of Classification Search
CPC ..... H01R 13/62933; H01R 13/62938; H01R 13/62955; H01R 13/62977; H01R 13/62988
USPC ..... 439/372, 157
See application file for complete search history.

(56) References Cited

U.S. PATENT DOCUMENTS 5,938,458 A * 8/1999 Krehbiel ..... H01R 13/62938 439/157
6,168,445 B1 * 1/2001 Seutschniker ... H01R 13/62933 439/157
6,213,795 B1 * 4/2001 Drescher ..... H01R 13/62977 439/152
6,899,554 B1 * 5/2005 Osada ..... H01R 13/62938 439/157
7,004,769 B1 * 2/2006 Putnam ..... H01R 13/62977 439/157
7,695,296 B1 * 4/2010 Hitchcock ..... H01R 13/62922 439/157
8,197,270 B2 * 6/2012 Vasbinder ..... H01R 13/62922 439/157

(Continued)

FOREIGN PATENT DOCUMENTS

JP 2011-70842 A 4/2011

*Primary Examiner* — Hae Moon Hyeon
(74) *Attorney, Agent, or Firm* — Sughrue Mion, PLLC

(57) ABSTRACT

A lever-type connector includes a housing having support holes; a fitting part provided inside the housing and fitted in a counterpart connector; a lever that includes a pair of plate-like portions facing each other in an opposed manner, a connection portion connecting the pair of plate-like portions with each other, and projection portions provided respective outside surfaces of the pair of plate-like portions, the lever being rotatably supported by the housing while the projection portions are engaged with the support holes; and sliding members each includes a guide portion that is slidably supported by the housing and engaged with a part to be guided provided to the counterpart connector, the sliding members being slid depending on a rotation of the lever to depress the part to be guided by way of the guide portion and fit the counterpart connector in the fitting part.

4 Claims, 18 Drawing Sheets

(56) References Cited

U.S. PATENT DOCUMENTS

| | | | | |
|---|---|---|---|---|
| 8,882,521 | B2 * | 11/2014 | Conway | H01R 13/5213 439/157 |
| 9,048,579 | B2 * | 6/2015 | Itou | H01R 13/62944 |
| 2005/0020114 | A1 * | 1/2005 | Denter | H01R 13/6271 439/157 |
| 2006/0040536 | A1 * | 2/2006 | Putnam | H01R 13/62977 439/157 |
| 2011/0070763 | A1 | 3/2011 | Kobayashi et al. | |

* cited by examiner

LEVER-TYPE CONNECTOR

CROSS-REFERENCE TO RELATED APPLICATION(S)

The present application claims priority to and incorporates by reference the entire contents of Japanese Patent Application No. 2016-041842 filed in Japan on Mar. 4, 2016.

BACKGROUND OF THE INVENTION

1. Field of the Invention

The present invention relates to a lever-type connector.

2. Description of the Related Art

Conventionally, there has been a lever-type connector. As one example of the lever-type connector, Japanese Patent Application Laid-open No. 2011-70842 discloses a technique of a lever-type connector including a detection projection with which parallel plates are brought into contact by a rotating operation of a lever erroneously mounted on a connector housing in the direction reverse to an attachment direction of a wire cover, and a rotation inhibiting means that inhibits the rotation of the lever by the displacement of the parallel plates, when the parallel plates run on the detection projection that extends between a shaft and a rest hole.

The lever-type connector leaves much room for improvement in that the lever is attached to the housing in a desired posture. For example, it is preferable to improve workability when the lever is engaged with a member in the housing in a desired posture in assembling processes.

SUMMARY OF THE INVENTION

It is an object of the present invention to provide a lever-type connector capable of improving the workability in the assembling processes.

According to one aspect of the present invention, a lever-type connector includes a housing having support holes; a fitting part provided inside the housing and fitted in a counterpart connector; a lever that includes a pair of plate-like portions facing each other in an opposed manner, a connection portion connecting the pair of plate-like portions with each other, and projection portions provided respective outside surfaces of the pair of plate-like portions, the lever being rotatably supported by the housing while the projection portions are engaged with the support holes; and sliding members each includes a guide portion that is slidably supported by the housing and engaged with a part to be guided provided to the counterpart connector, the sliding members being slid depending on a rotation of the lever to depress the part to be guided by way of the guide portion and fit the counterpart connector in the fitting part, wherein an inside wall surface of the housing has grooves each extending from an edge portion of the housing to the support holes, and the projection portions are allowed to pass through the grooves toward the support holes when a rotational position of the lever about a rotational axis of the lever is a predetermined position.

According to another aspect of the present invention, in the lever-type connector, it is preferable that the projection portions each includes a proximal-end-side projection portion projecting from the outside surface of each of the pair of plate-like portions and formed in a circular shape as viewed in a cross-sectional view orthogonal to the rotational axis of the lever, and a distal-end-side projection portion projecting from the proximal-end-side projection portion and formed in a belt shape as viewed in a cross sectional view orthogonal to the rotational axis, and the grooves allow the distal-end-side projection portion to pass therethrough when the rotational position about the rotational axis of the lever is the predetermined position.

According to still another aspect of the present invention, in the lever-type connector, it is preferable that the sliding members each includes a first gear part including a plurality of gear teeth continuously arranged along a sliding direction of the sliding members, the lever includes a second gear part provided to an end portion opposite to the connection portion in the plate-like portions and meshed with the first gear part, and rotating motion of the lever is converted into sliding motion of the sliding members in a meshing portion between the first gear part and the second gear part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a lever-type connector according to an embodiment of the present invention is specifically explained with reference to drawings. Here, the present invention is not limited to the embodiment. Furthermore, components in the following embodiment include components that are easily conceivable by those skilled in the art or are substantially equal to each other.

Embodiment

Figure 1:
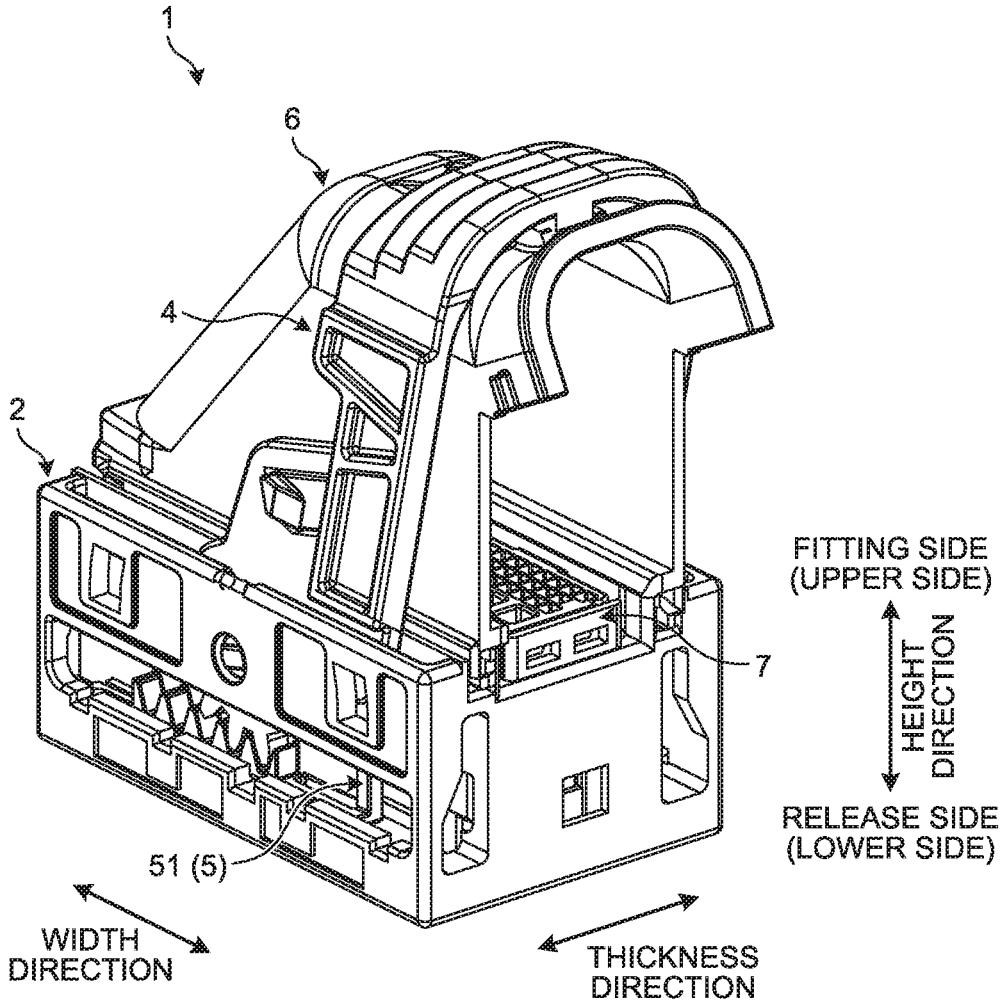
FIG. 1 is a perspective view of a lever-type connector according to the present embodiment.
Figure 2:
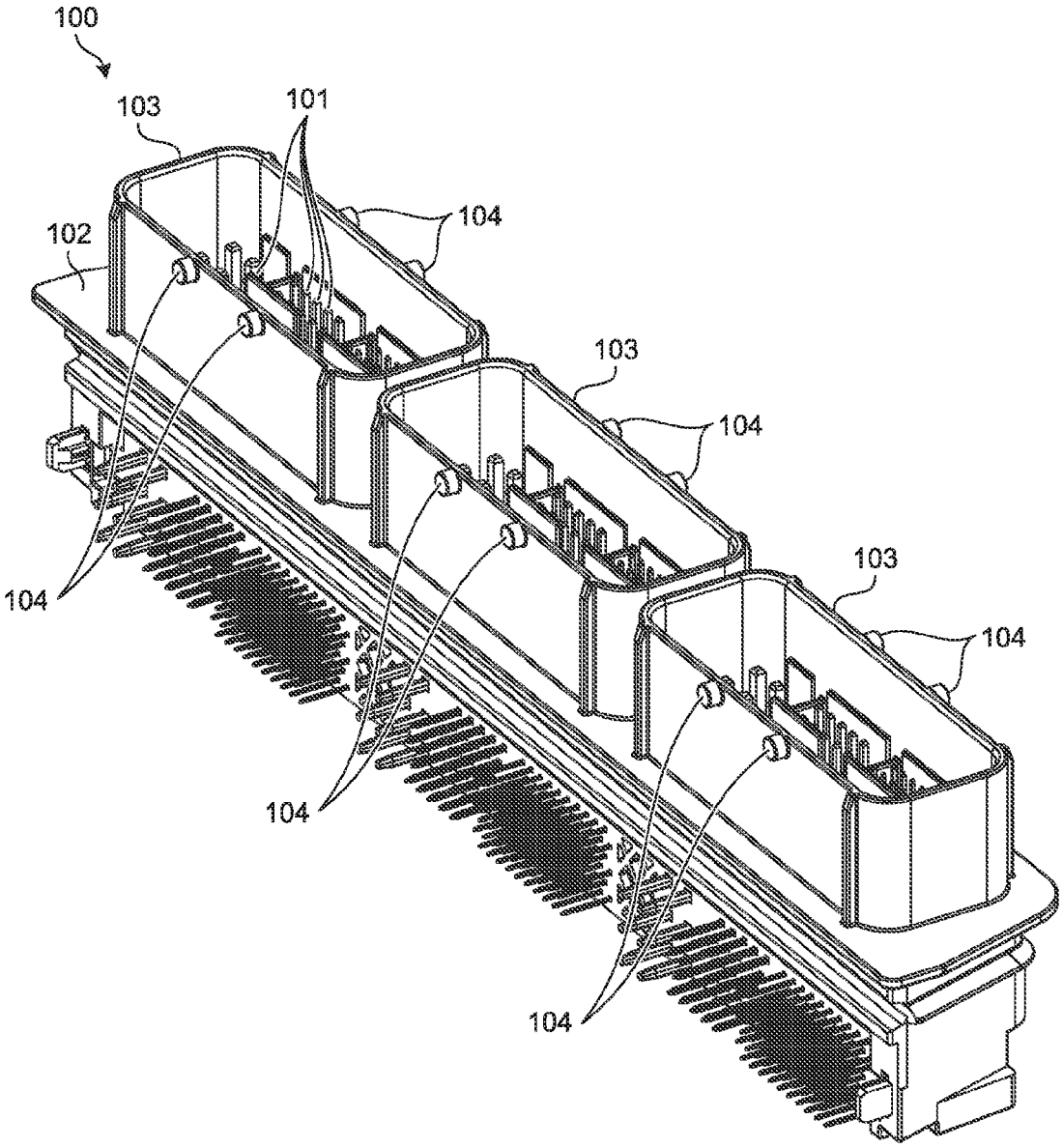
FIG. 2 is a perspective view illustrating one example of a counterpart connector.
Figure 3:
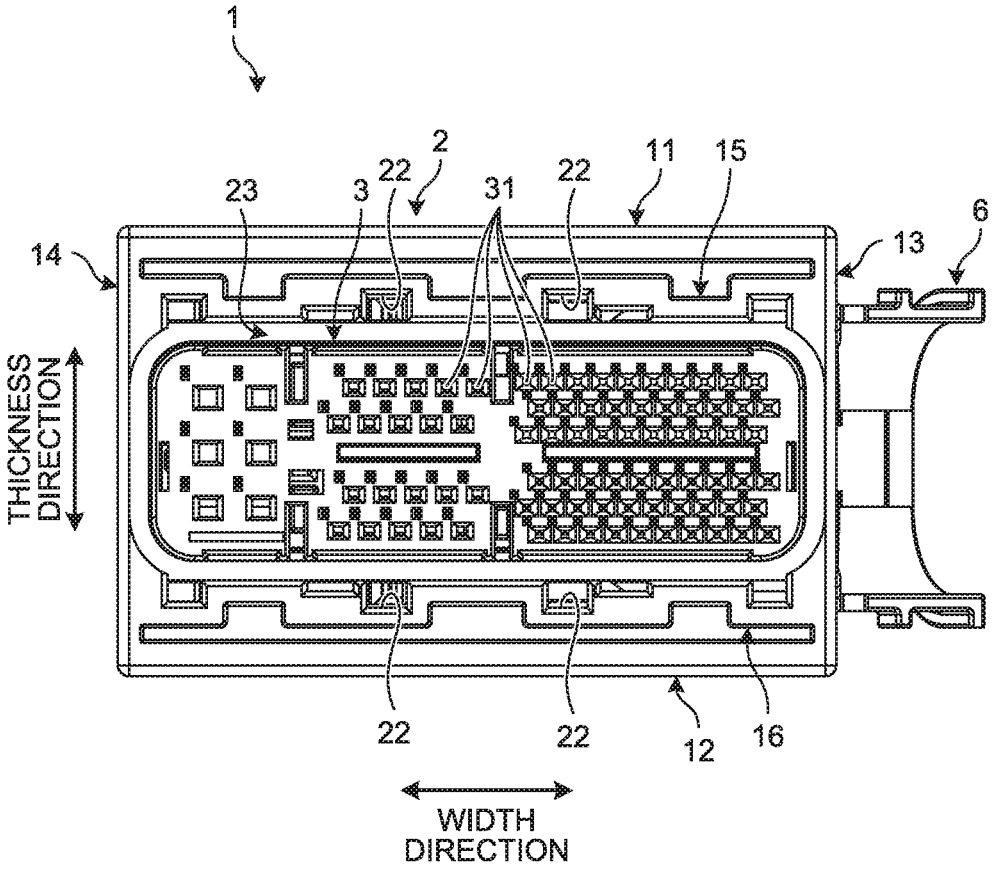
FIG. 3 is a bottom view of the lever-type connector according to the present embodiment.
Figure 4:
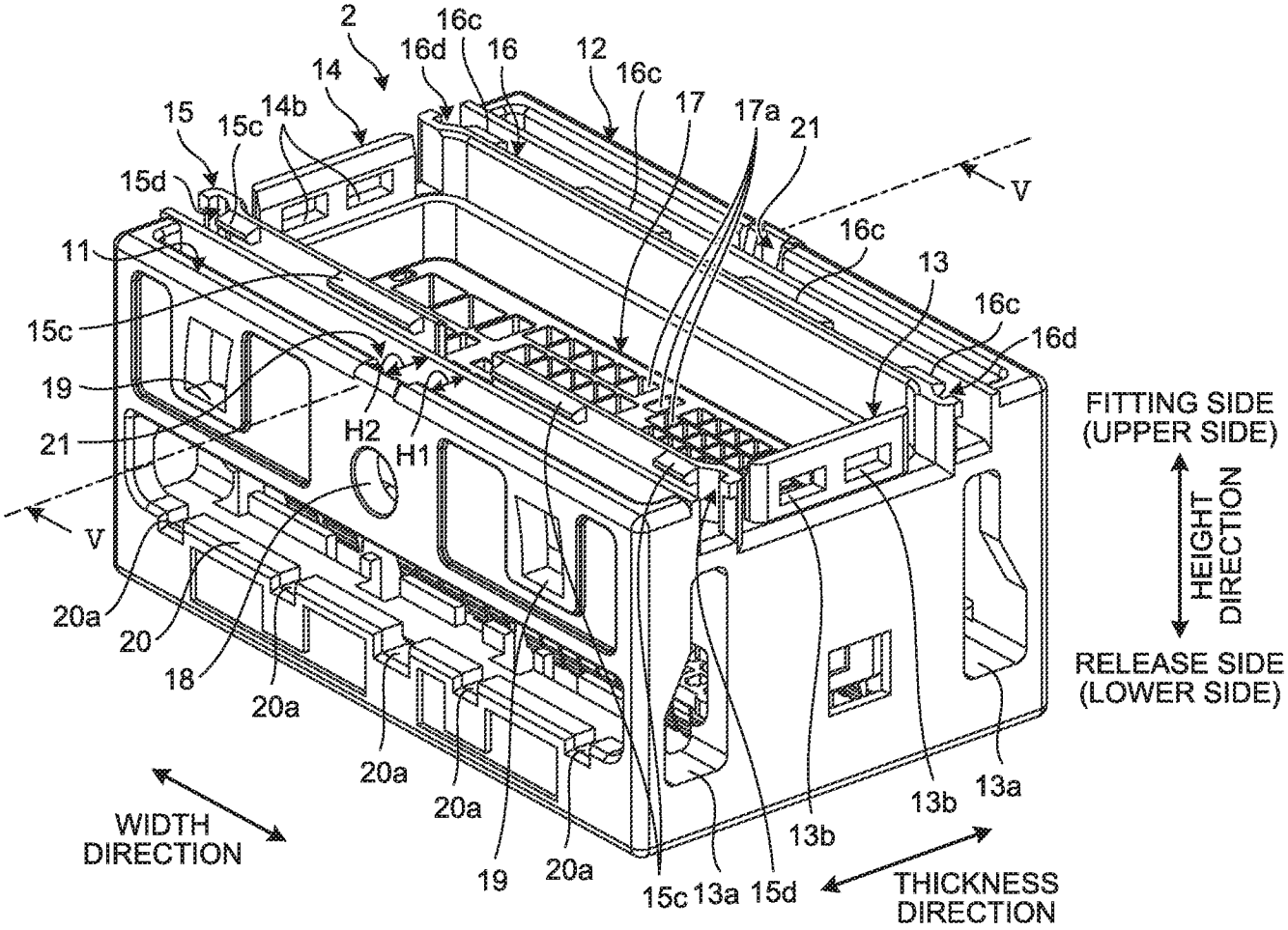
FIG. 4 is a perspective view of a housing according to the present embodiment.
Figure 5:
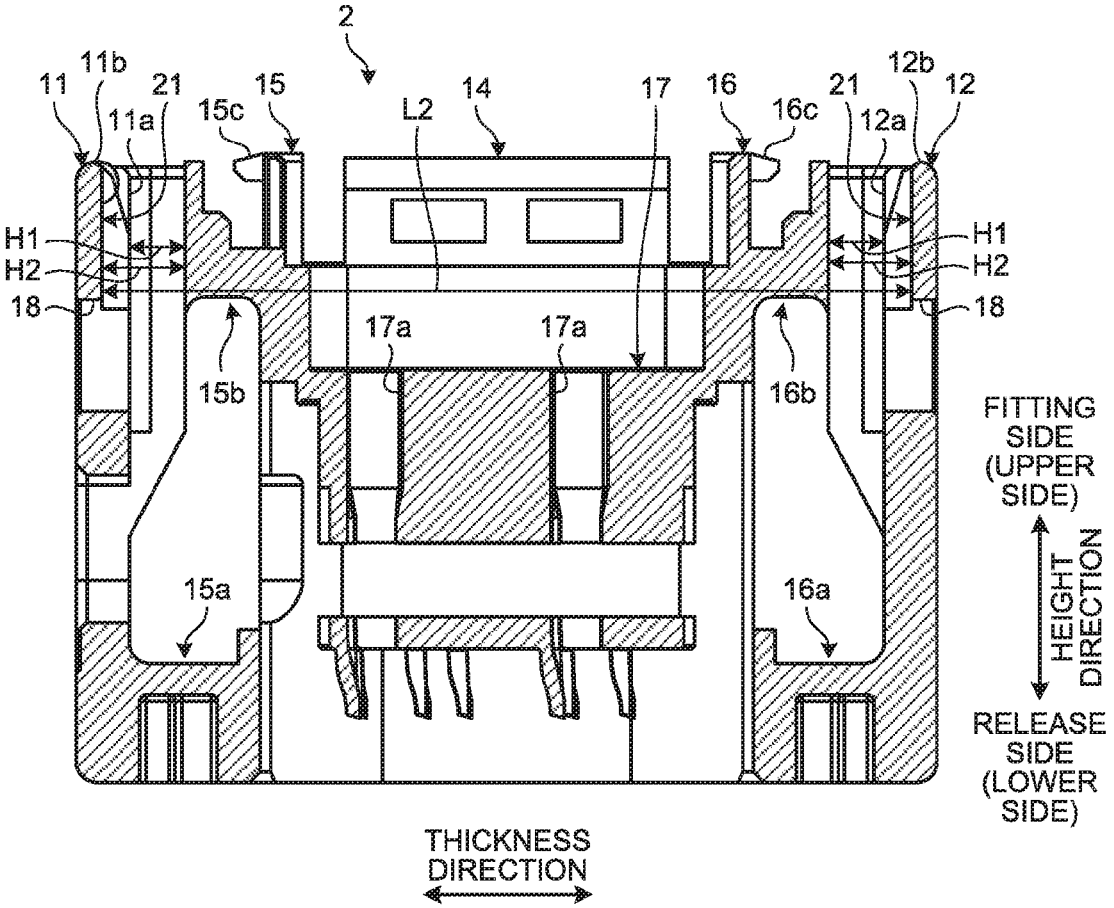
FIG. 5 is a cross-sectional view of the housing according to the present embodiment.
Figure 6:
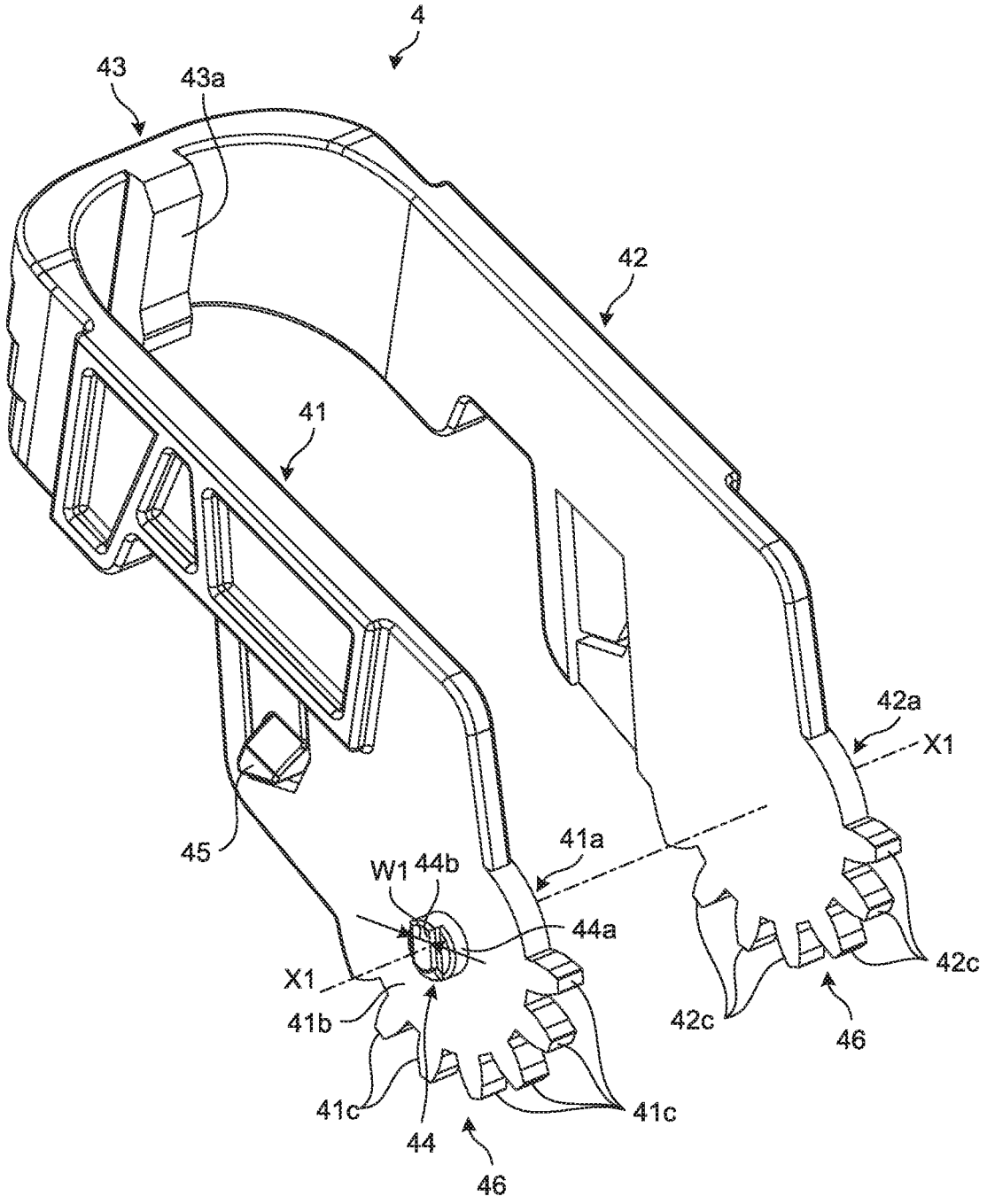
FIG. 6 is a perspective view of a lever according to the present embodiment.
Figure 7:
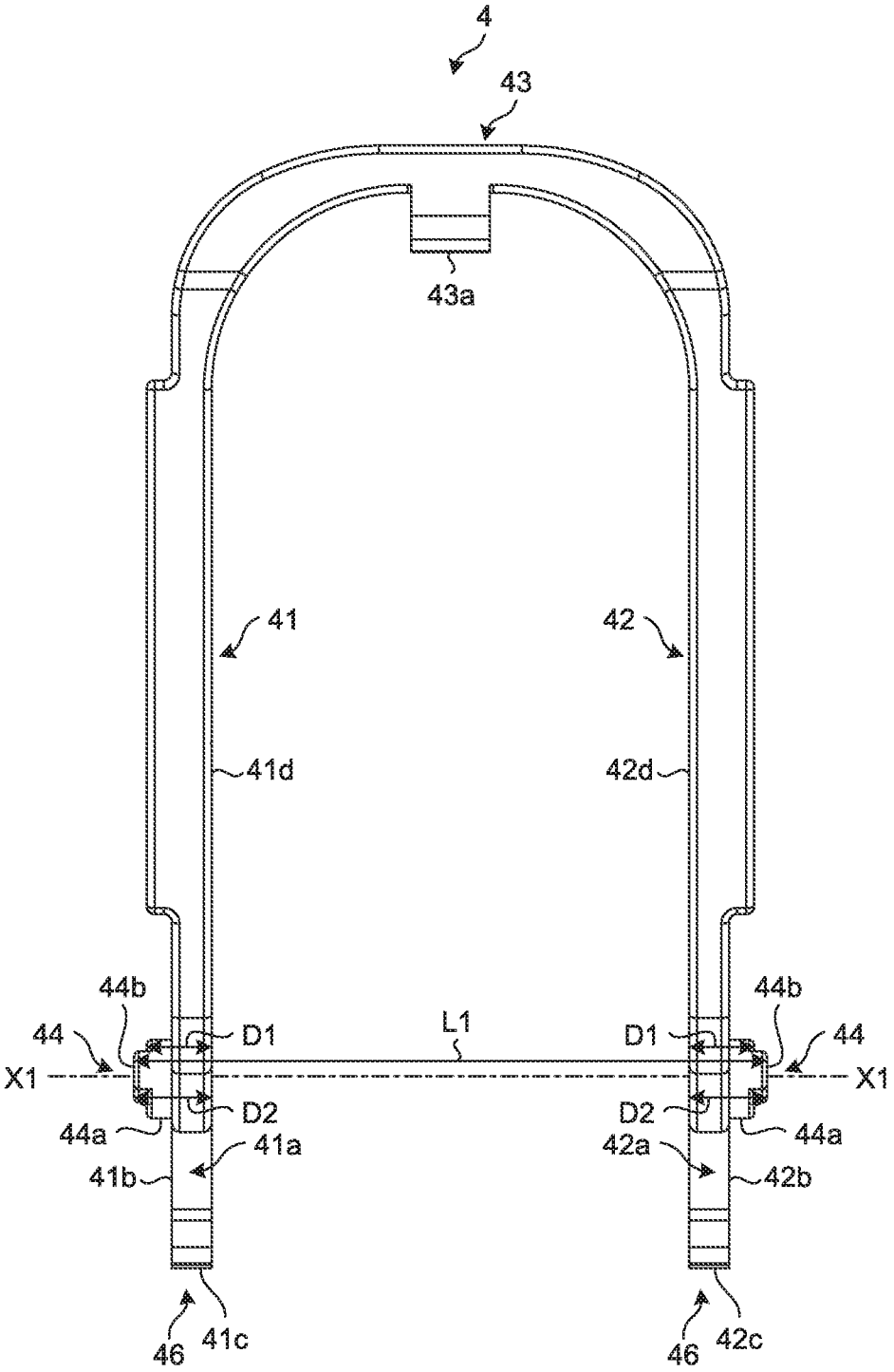
FIG. 7 is a plan view of the lever according to the present embodiment.
Figure 8:
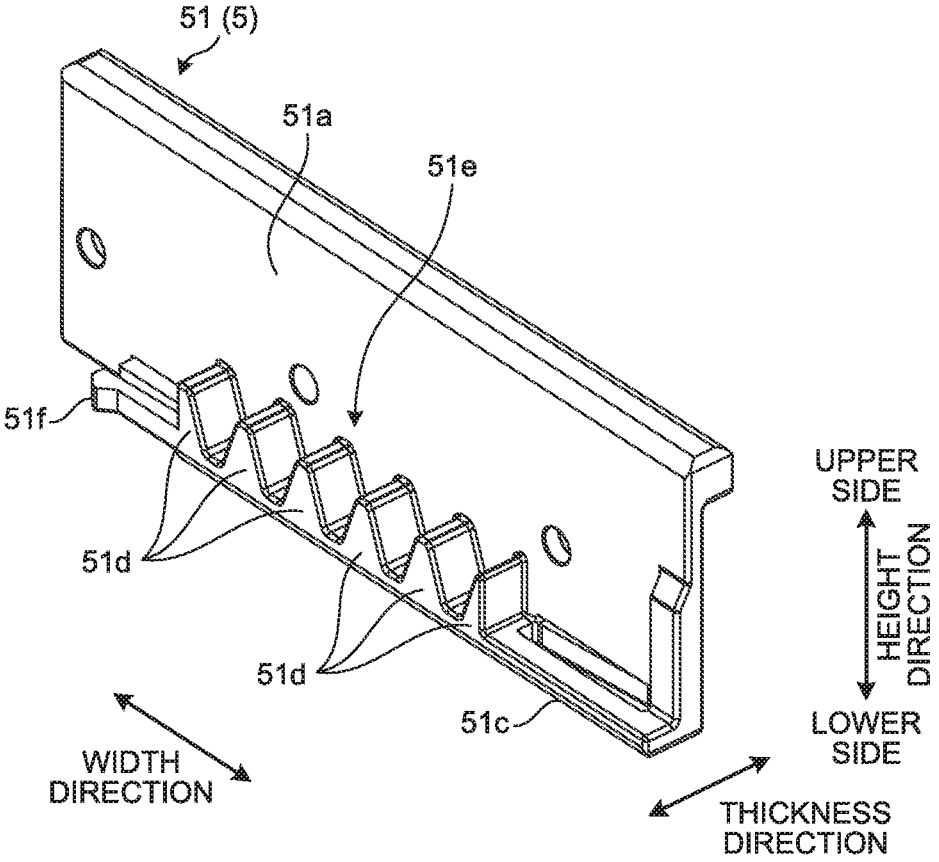
FIG. 8 is a perspective view of a first sliding member according to the present embodiment.
Figure 9:
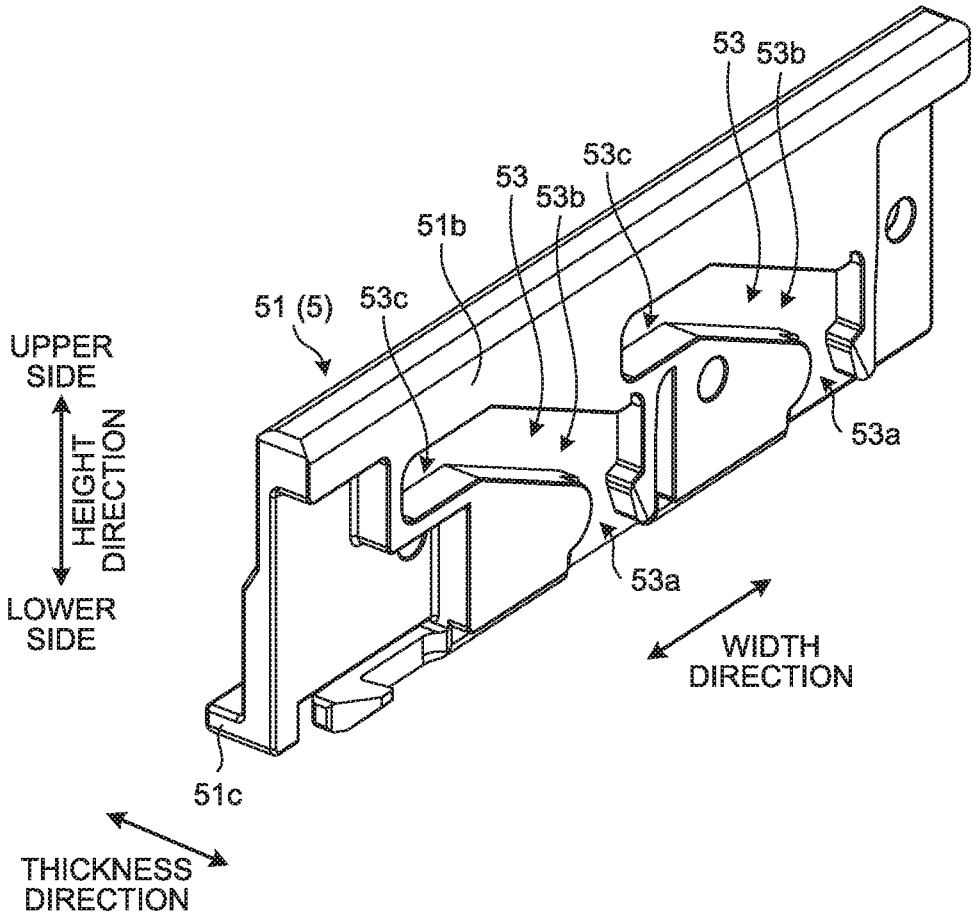
FIG. 9 is another perspective view of the first sliding member according to the present embodiment.
Figure 10:
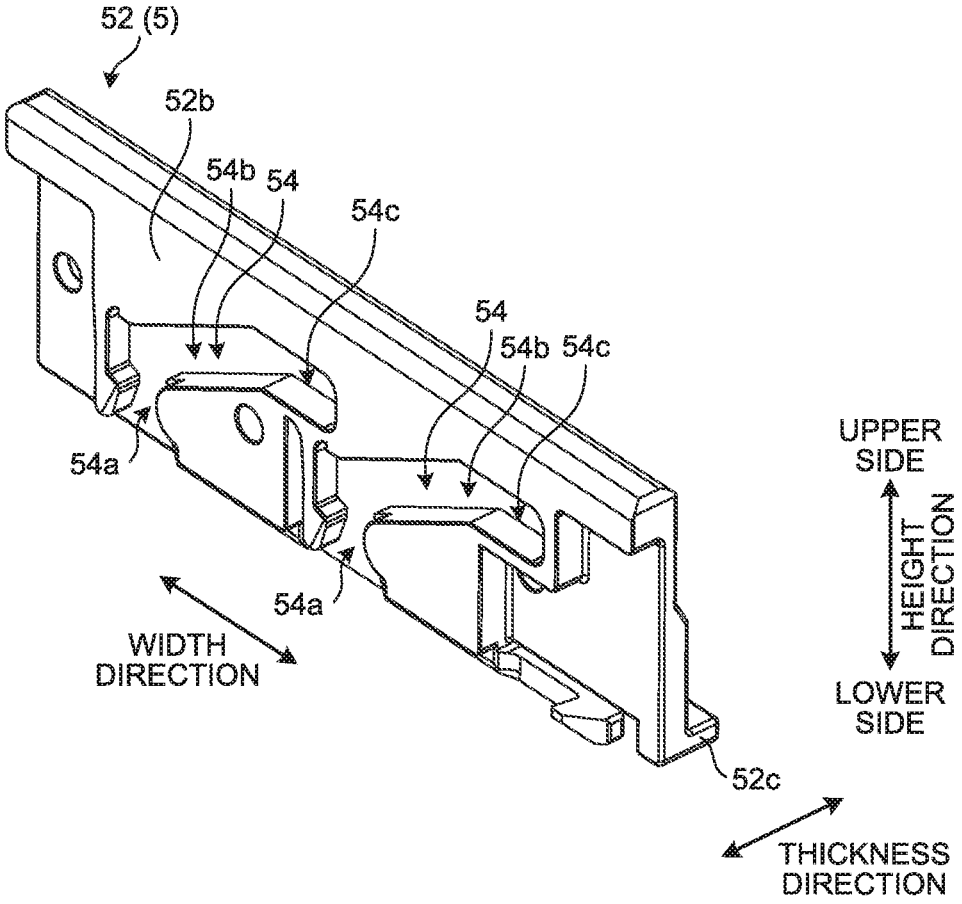
FIG. 10 is a perspective view of a second sliding member according to the present embodiment.
Figure 11:
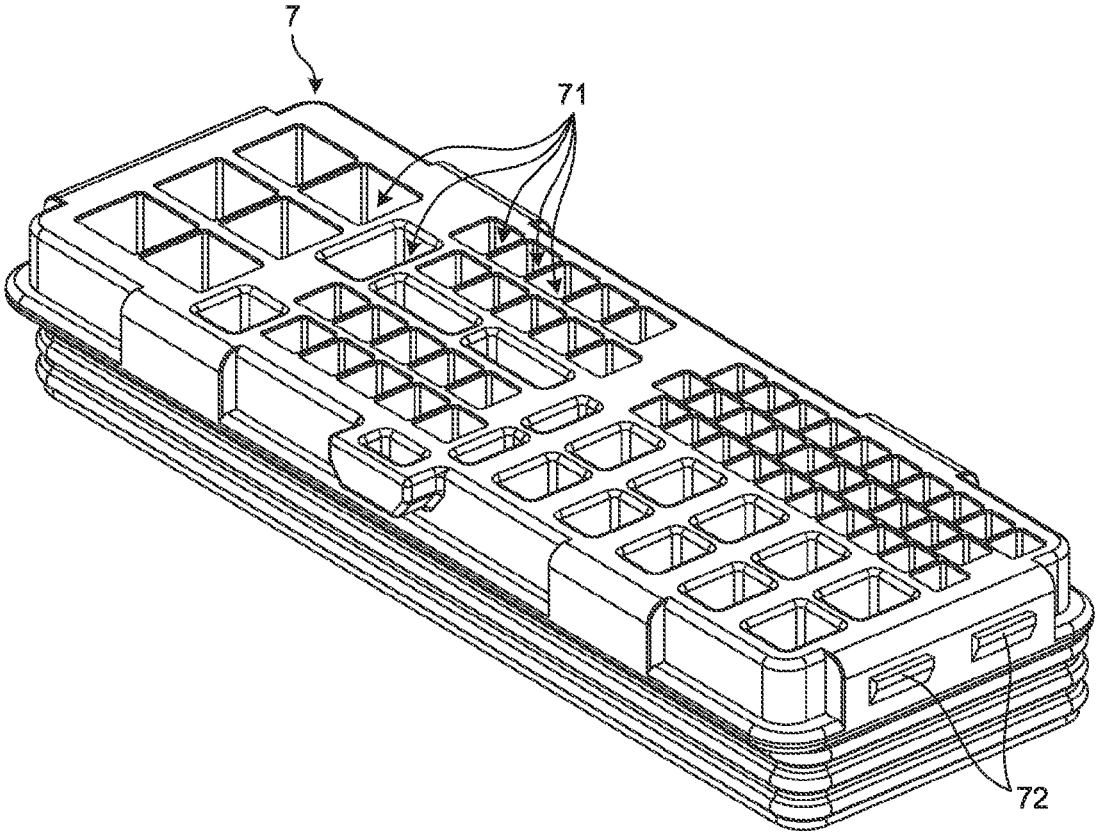
FIG. 11 is a perspective view of an electric wire holding part according to the present embodiment.
Figure 12:
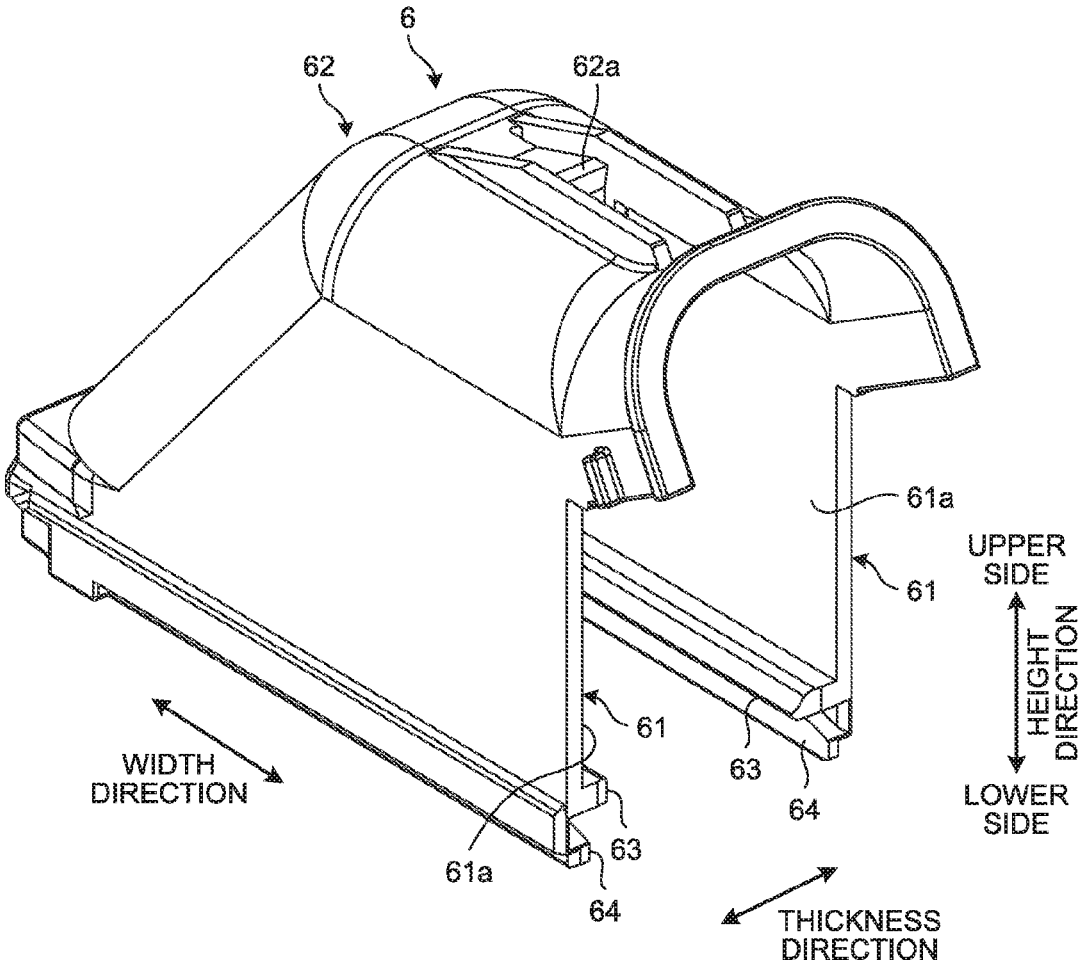
FIG. 12 is a perspective view of a cover according to the present embodiment.

The embodiment is explained with reference to FIG. 1 to FIG. 18. The present embodiment relates to the lever-type connector. FIG. 1 is a perspective view of the lever-type connector according to the present embodiment, FIG. 2 is a perspective view illustrating one example of a counterpart connector, FIG. 3 is a bottom view of the lever-type connector according to the present embodiment, FIG. 4 is a perspective view of a housing according to the present embodiment, FIG. 5 is a cross-sectional view of the housing according to the present embodiment, FIG. 6 is a perspective view of a lever according to the present embodiment, FIG. 7 is a plan view of the lever according to the present embodiment, FIG. 8 is a perspective view of a first sliding member according to the present embodiment, FIG. 9 is another perspective view of the first sliding member according to the present embodiment, FIG. 10 is a perspective view of a second sliding member according to the present embodiment, FIG. 11 is a perspective view of an electric wire holding part according to the present embodiment, and FIG. 12 is a perspective view of a cover according to the present embodiment. FIG. 5 illustrates a cross-sectional view taken along a line V-V in FIG. 4.

As illustrated in FIG. 1, a lever-type connector 1 according to the present embodiment has a housing 2, a lever 4, sliding members 5, and a cover 6. The housing 2 is a housing that houses a fitting part 3 (see FIG. 3) or the like mentioned below. The lever-type connector 1 in the present embodiment is a female connector to be fitted in a counterpart connector 100 illustrated in FIG. 2. The counterpart connector 100 is a male connector having a male terminal 101. The counterpart connector 100 illustrated in FIG. 2 has a main body 102, a tubular part 103, parts to be guided 104, and the male terminal 101. The main body 102 is a housing formed in an approximately rectangular parallelepiped shape. The tubular part 103 is a tubular component projecting from the main body 102. The cross-sectional shape of the tubular part 103 is a rectangular shape. The male terminal 101 projects toward the internal space of the tubular part 103 from the main body 102. The part to be guided 104 is a projection portion projecting from the side surface of the tubular part 103. The shape of the part to be guided 104 in the present embodiment is a columnar shape. The part to be guided 104 projects toward the outside of the tubular part 103 from each of a pair of wall portions of the tubular part 103, the wall portions facing each other in an opposed manner. Each of the pair of wall portions includes two parts to be guided 104. The two parts to be guided 104 are arranged on the distal end portion of the tubular part 103 in a predetermined spaced apart manner.

As illustrated in FIG. 3, the lever-type connector 1 has the fitting part 3. The fitting part 3 is held by the housing 2. The tubular part 103 of the counterpart connector 100 is inserted into a fitting groove 23 formed between the inner surface of the housing 2 and the outer surface of the fitting part 3 thus being fitted in the fitting part 3. The male terminal 101 of the counterpart connector 100 is inserted into an opening 31 of the fitting part 3 thus being electrically connected with the female terminal held in the inside of the fitting part 3.

As illustrated in FIG. 4, the housing 2 has outer wall portions 11, 12, 13, and 14, partition walls 15 and 16, and a holding part 17. The outer wall portions 11, 12, 13, and 14, the partition walls 15 and 16, and the holding part 17 are formed of a synthetic resin material or the like as an integral body. The outer wall portions 11, 12, 13, and 14 constitute the outer wall of the housing 2. The outer wall portions 11, 12, 13, and 14 in the present embodiment constitute a rectangular tube formed in a rectangular shape as viewed in a cross-sectional view. The first outer wall portion 11 and the second outer wall portion 12 face each other in an opposed manner in the thickness direction of the housing 2. The third outer wall portion 13 and the fourth outer wall portion 14 face each other in an opposed manner in the width direction of the housing 2. The fitting part 3 mentioned above is engaged with the holding part 17.

In the housing 2 of the present embodiment, the "width direction" indicates a longitudinal direction of the housing 2 as viewed in a plan view, and the "thickness direction" indicates a transverse direction of the housing 2 as viewed in a plan view. The width direction and the thickness direction are orthogonal to each other. Furthermore, in the housing 2, a "height direction" indicates an axial direction of the tube constituted of the outer wall portions 11, 12, 13, and 14, and indicates a direction orthogonal to each of the width direction and the thickness direction. In the present specification, a side of the housing 2 that is covered with the cover 6 (see FIG. 1) is referred to as "upper side", and a side of the housing 2 that is fitted in the counterpart connector 100 is referred to as "lower side." However, the "upper side" and the "lower side" do not always coincide with an upper side and a lower side in the vertical direction in a state in which the lever-type connector 1 is actually mounted on an instrument, respectively. The counterpart connector 100 is fitted in the lever-type connector 1 from the lower side in the height direction. The direction of the relative movement of the counterpart connector 100 when being fitted is a direction in which the counterpart connector 100 relatively moves to the upper side from the lower side in the height direction with respect to the lever-type connector 1. Accordingly, in the present specification, the upper side in the height direction is also referred to as "fitting side", and the lower side in the height direction is also referred to as "release side."

The first partition wall 15 is a wall portion that faces the first outer wall portion 11 in an opposed manner, and is arranged on the inner side of the housing 2 as viewed from the first outer wall portion 11. One end of the first partition wall 15 in the width direction is connected to the third outer wall portion 13, and the other end of the first partition wall 15 is connected to the fourth outer wall portion 14. The second partition wall 16 is a wall portion that faces the second outer wall portion 12 in an opposed manner, and is arranged on the inner side of the housing 2 as viewed from the second outer wall portion 12. One end of the second partition wall 16 in the width direction is connected to the third outer wall portion 13, and the other end of the second partition wall 16 is connected to the fourth outer wall portion 14. The holding part 17 holds a female terminal in the inside thereof. The holding part 17 is connected to each of the third outer wall portion 13, the fourth outer wall portion 14, the first partition wall 15, and the second partition wall 16. The holding part 17 has a plurality of insertion openings 17*a* into which the respective female terminals are inserted. In the innermost of the insertion opening 17*a*, an engagement part that is engaged with the female terminal inserted to restrict the movement of the female terminal is arranged.

The first outer wall portion 11 includes a support hole 18, two temporary engaging holes 19, and an insertion hole 20. The support hole 18 penetrates the first outer wall portion 11 in the wall thickness direction. The support hole 18 supports the lever 4 in a rotatable manner, as mentioned below. The cross-sectional shape of the support hole 18 in the present embodiment is a circular shape. The support hole 18 is located at a center portion in the width direction of the first outer wall portion 11, and at a position above the center portion in the height direction of the first outer wall portion 11.

The temporary engaging hole 19 penetrates the first outer wall portion 11 in the wall thickness direction. The temporary engaging hole 19 holds the lever 4 at a temporary engaging position, as mentioned below. The shape of the temporary engaging hole 19 in the present embodiment is a rectangular shape. The temporary engaging hole 19 is located at a position above the center portion in the height direction of the first outer wall portion 11. One of the temporary engaging holes 19 is arranged in one end portion in the width direction of the first outer wall portion 11, and the other temporary engaging hole 19 is arranged in the other end portion in the width direction of the first outer wall portion 11.

The insertion hole 20 penetrates the first outer wall portion 11 in the wall thickness direction. The insertion hole 20 is a hole that enables, when a member is inserted into the inside of the housing 2, insertion of the member therethrough. A plurality of cutouts 20*a* are provided to the lower edge of the insertion hole 20. The cutout 20*a* has, as mentioned below, a function for the positioning of the sliding member 5, and a function that restricts the sliding motion of the sliding member 5. The cutouts 20*a* are arranged at predetermined intervals along the width direction.

The second outer wall portion 12 includes the support hole 18 that is formed and arranged in the same manner as the case of the support hole 18 of the first outer wall portion 11. The second outer wall portion 12 includes the temporary engaging holes 19 that are formed and arranged in the same manner as the case of the temporary engaging holes 19 of the first outer wall portion 11. Furthermore, the second outer wall portion 12 includes a plurality of through holes each of which functions in the same manner as the case of the cutout 20*a* of the first outer wall portion 11.

The third outer wall portion 13 includes two insertion holes 13*a*. The insertion hole 13*a* penetrates the third outer wall portion 13 in the wall thickness direction. One of the insertion holes 13*a* is arranged between the first outer wall portion 11 and the first partition wall 15. The other insertion hole 13*a* is arranged between the second outer wall portion 12 and the second partition wall 16. The insertion hole 13*a* is formed in a shape that enables insertion of the sliding member 5 thereinto. One of the pair of sliding members 5 is inserted into a space portion between the first outer wall portion 11 and the first partition wall 15 through one of the insertion holes 13*a*, and the other sliding member 5 is inserted into a space portion between the second outer wall portion 12 and the second partition wall 16 through the other insertion hole 13*a*. The fourth outer wall portion 14 includes insertion holes same as the respective insertion holes 13*a*. That is, the housing 2 in the present embodiment enables insertion of the sliding member 5 thereinto from both sides thereof in the width direction. The third outer wall portion 13 and the fourth outer wall portion 14 have a pair of engagement holes 13*b* and a pair of engagement holes 14*b*, respectively. The engagement holes 13*b* and 14*b* are arranged in the respective upper ends of the outer wall portions 13 and 14.

As illustrated in FIG. 3, the housing 2 has passages 22. The passages 22 are grooves provided to the surface of the first partition wall 15 that faces the fitting part 3, and grooves provided to the surface of the second partition wall 16 that faces the fitting part 3. The passage 22 extends toward the upper side of the housing 2 from the bottom surface of the housing 2 in the height direction. As mentioned below, the passage 22 allows the part to be guided 104 (see FIG. 2) of the counterpart connector 100 to pass therethrough, and guides the part to be guided 104 to the inside of the housing 2 to engage the part to be guided 104 with the sliding member 5. The fitting groove 23 is formed between the inner surface of the housing 2 and the outer surface of the fitting part 3. The fitting groove 23 is a recessed portion formed in a substantially rectangular tubular shape, the recessed portion corresponding to the tubular part 103 of the counterpart connector 100.

As illustrated in FIG. 5, the housing 2 has grooves 21. The grooves 21 are provided to respective inside surfaces 11*a* and 12*a* of the first outer wall portion 11 and the second outer wall portion 12. The groove 21 of the first outer wall portion 11 extends from an upper edge portion 11*b* of the first outer wall portion 11 to the support hole 18 in the height direction. One end of the groove 21 of the first outer wall portion 11 is opened toward the upper space of the first outer wall portion 11, and the other end of the groove 21 is opened toward the internal space of the support hole 18 provided to the first outer wall portion 11. The groove 21 of the second outer wall portion 12 extends from an upper edge portion 12*b* of the second outer wall portion 12 to the support hole 18 in the height direction. One end of the groove 21 of the second outer wall portion 12 is opened toward the upper space of the second outer wall portion 12, and the other end of the groove 21 is opened toward the internal space of the support hole 18 provided to the second outer wall portion 12.

As illustrated in FIG. 5, the size of the clearance between the outer wall portion 11 (12) and the partition wall 15 (16) is determined as follows. In the peripheral area of the groove 21, the size of the clearance between the first outer wall portion 11 and the first partition wall 15 is indicated by a symbol H1. In the area to which the groove 21 is provided, the size of the clearance between the first outer wall portion 11 and the first partition wall 15 is indicated by a symbol H2. That is, the distance from the bottom of the groove 21 to the wall surface of the first partition wall 15 facing the groove 21 is indicated by the symbol H2. The size of the clearance H2 is larger than the size of the clearance H1. In the same manner as above, in the peripheral area of the groove 21, the size of the clearance between the second outer wall portion 12 and the second partition wall 16 is indicated by a symbol H1. In the area to which the groove 21 is provided, the size of the clearance between the second outer wall portion 12 and the second partition wall 16 is indicated by a symbol H2.

The first partition wall 15 has guide projections 15*c*. The guide projection 15*c* is arranged on the upper edge portion of the first partition wall 15, and projects toward the first outer wall portion 11 in the thickness direction. The guide projections 15*c* are, as illustrated in FIG. 4, arranged in a spaced-apart manner along the width direction. As illustrated in FIG. 4, the first partition wall 15 has recessed portions 15*d*. The respective recessed portions 15*d* are arranged on both ends of the first partition wall 15 in the width direction. The recessed portion 15*d* is provided to the surface of the first partition wall 15 that faces the first outer wall portion 11 in an opposed manner, and extends in the height direction. The second partition wall 16 includes guide projections 16*c* arranged in the same manner as the case of the guide projections 15*c*, and recessed portions 16*d* arranged in the same manner as the case of the recessed portions 15*d*.

As illustrated in FIG. 5, the first outer wall portion 11 and the first partition wall 15 are connected to each other in the lower portions thereof in the height direction. The portion where the first outer wall portion 11 and the first partition wall 15 are connected to each other constitutes a lower guide groove 15*a* that guides the bottom end portion of the sliding member 5. Furthermore, the first partition wall 15 has an upper guide groove 15*b*. Each of the lower guide groove 15*a* and the upper guide groove 15*b* extends in the width direction. The upper guide groove 15*b* guides the upper end portion of the sliding member 5. The second outer wall portion 12 and the second partition wall 16 are connected to each other in the lower portions thereof in the height direction. The portion where the second outer wall portion 12 and the second partition wall 16 are connected to each other constitutes a lower guide groove 16*a* that guides the bottom end portion of the sliding member 5. Furthermore, the second partition wall 16 has an upper guide groove 16*b*. Each of the lower guide groove 16*a* and the upper guide groove 16*b* extends in the width direction. The upper guide groove 16*b* guides the upper end portion of the sliding member 5.

As illustrated in FIG. 6 and FIG. 7, the lever 4 has a pair of plate-like portions 41 and 42, a connection portion 43, projection portions 44, and engaging claws 45. The pair of plate-like portions 41 and 42 face each other in an opposed manner. The plate-like portions 41 and 42 have respective circular portions 41*a* and 42*a* arranged at the distal ends thereof. Each of the circular portions 41*a* and 42*a* is a constitutional portion formed in a substantially semicircular plate-like shape. Each of the circular portions 41*a* and 42*a* includes the projection portion 44 arranged in the center of the circular arc thereof. The projection portion 44 of the circular portion 41*a* projects from an outside surface 41*b*. The outside surface 41*b* is a surface of the circular portion 41*a* that is opposite to the circular portion 42*a* side of the circular portion 41*a*. The projection portion 44 of the circular portion 42*a* projects from an outside surface 42*b*. The outside surface 42*b* is a surface of the circular portion 42*a* that is opposite to the circular portion 41*a* side of the circular portion 42*a*.

The projection portion 44 has a proximal-end-side projection portion 44*a* and a distal-end-side projection portion 44*b*. The proximal-end-side projection portion 44*a* is a projection that projects from each of the outside surfaces 41*b* and 42*b*, and is formed in a circular shape as viewed in a cross-sectional view orthogonal to a rotational axis X1 of the lever 4. That is, the proximal-end-side projection portion 44*a* in the present embodiment is formed in a columnar shape, and projects in the direction orthogonal to each of the outside surfaces 41*b* and 42*b*. The rotational axis X1 constitutes a central axis line of the proximal-end-side projection portion 44*a*. The proximal-end-side projection portion 44*a* is supported by the housing 2 in a rotatable manner about the rotational axis X1.

The distal-end-side projection portion 44*b* is a projection that projects from the proximal-end-side projection portion 44*a*, and is formed in a belt shape as viewed in a cross-sectional view orthogonal to the rotational axis X1. The distal-end-side projection portion 44*b* in the present embodiment is formed in a truncated pyramid shape, and projects in the direction orthogonal to the distal-end surface of the proximal-end-side projection portion 44*a*. The distal-end-side projection portion 44*b* is a projection portion with a predetermined width, the projection portion extending toward both sides from the rotational axis X1 in the radial direction. The distal-end-side projection portion 44*b* is formed in a substantially rectangular shape as viewed in the direction of the rotational axis X1, and inserted into the groove 21 of the housing 2 along the longitudinal direction thereof. The distal-end-side projection portion 44*b* in the present embodiment has a width W1 (see FIG. 6) that is constant. The length of the distal-end-side projection portion 44*b* is longer than the width W1. The width W1 of the distal-end-side projection portion 44*b* is, for example, approximately one-half of the length of the diameter of the proximal-end-side projection portion 44*a*. The length of the base of the distal-end-side projection portion 44*b*; that is, the length of the hem portion of the distal-end-side projection portion 44*b* in the longitudinal direction, is identical with the size of the diameter of the proximal-end-side projection portion 44*a*. The end portion of distal-end-side projection portion 44*b* includes a leading inclined portion.

As illustrated in FIG. 7, with respect to the projection portion 44 of the first plate-like portion 41, the thickness from an inside surface 41*d* of the first plate-like portion 41 to the distal-end surface of the proximal-end-side projection portion 44*a* is indicated by a symbol D1, and the thickness from the inside surface 41*d* to the distal end of the distal-end-side projection portion 44*b* is indicated by a symbol D2. In the same manner as above, with respect to the projection portion 44 of the second plate-like portion 42 also, the thickness D1 from an inside surface 42*d* to the distal-end surface of proximal-end-side projection portion 44*a*, and the thickness D2 from the inside surface 42*d* to the distal-end-side projection portion 44*b* are specified. In the lever-type connector 1 according to the present embodiment, the sizes of the clearances H1 and H2 (see FIG. 5) of the housings 2, and the thicknesses D1 and D2 of the lever 4 are determined so that the following expressions (1) is satisfied. That is, the distal-end-side projection portion 44*b* collides against the outer wall portion 11 (12) of the housing 2 in an area other than the groove 21, and is incapable of being inserted into the clearance between the outer wall portion 11 (12) and the partition wall 15 (16).

$$D1<H1<D2<H2 \quad (1)$$

The engaging claw 45 is arranged on the proximal-end side of the plate-like portion 41 (42) in a spaced-apart manner from the circular portion 41*a* (42*a*). The engaging claw 45 of the first plate-like portion 41 projects toward the outside of the first plate-like portion 41; that is, the engaging claw 45 of the first plate-like portion 41 projects in the direction toward the side opposite to the second plate-like portion 42 side of the first plate-like portion 41 from the second plate-like portion 42 side of the first plate-like portion 41. The engaging claw 45 of the second plate-like portion 42 projects toward the outside of the second plate-like portion 42; that is, the engaging claw 45 of the second plate-like portion 42 projects in the direction toward the side opposite to the first plate-like portion 41 side of the second plate-like portion 42 from the first plate-like portion 41 side of the second plate-like portion 42.

As illustrated in FIG. 7, the first plate-like portion 41 and the second plate-like portion 42 face each other in an opposed manner in the direction of the rotational axis X1, and are arranged in parallel to each other. The connection portion 43 connects the proximal end of the first plate-like portion 41 and the proximal end of the second plate-like portion 42 in the direction parallel to the rotational axis X1. The inside surface of the connection portion 43 includes an engaging projection 43*a*. The lever 4 is integrally formed of a raw material having flexibility, such as a synthetic resin material. The lever 4 is subject to a flexure deformation when an external force is applied to the plate-like portions 41 and 42 in the direction of the rotational axis X1 such that the plate-like portions 41 and 42 are brought close to each other. The flexure deformation is a deformation such that a distance L1 between the distal ends of the pair of projection portions 44 decreases. The distance L1 between the distal ends of the projection portions 44 is a distance from the distal-end surface of the distal-end-side projection portion 44*b* of the first plate-like portion 41 to the distal-end surface of the distal-end-side projection portion 44*b* of the second plate-like portion 42. The lever 4 is attached to the housing 2 in a state in which the lever 4 is subject to the flexure deformation.

The lever 4 has second gear parts 46. The second gear part 46 is provided to the end portion of the plate-like portion 41 (42) that is opposite to the connection portion 43 side of the plate-like portion 41 (42), and meshes with a first gear part 51*e* (see FIG. 8) mentioned below. The second gear part 46 in the present embodiment is arranged on each of the circular portions 41*a* and 42*a*. The second gear part 46 of the first plate-like portion 41 has a plurality of gear teeth 41*c*. The plurality of gear teeth 41*c* project from the outer peripheral face of the circular portion 41*a*, and are continuously arranged at predetermined intervals along the circumferential direction. The second gear part 46 of the second plate-like portion 42 has a plurality of gear teeth 42*c*. The plurality of gear teeth 42*c* project from the outer peripheral face of the circular portion 42*a*, and are continuously arranged at predetermined intervals along the circumferential direction.

The sliding member 5 has a first sliding member 51 illustrated in FIG. 8 and FIG. 9, and a second sliding member 52 illustrated in FIG. 10. Each direction illustrated in FIG. 8 to FIG. 10 is a direction in a state in which the sliding member 5 is housed in the housing 2. Each of the first sliding member 51 and the second sliding member 52 is integrally formed of a synthetic resin material or the like. Each of the first sliding member 51 and the second sliding member 52 is a member formed in a substantially rectangular plate-like shape. The shape of the first sliding member 51 and the shape of the second sliding member 52 are in plane symmetry. As illustrated in FIG. 8 and FIG. 9, the first sliding member 51 is a plate-like member, and has a bottom flange portion 51*c*, the first gear part 51*e*, and guide portions 53.

The bottom flange portion 51*c* projects from an outside surface 51*a* of the first sliding member 51. The outside surface 51*a* is a surface that faces outward in a state in which the first sliding member 51 is housed in the housing 2; that is, a surface that faces the first outer wall portion 11 of the housing 2 in an opposed manner. The bottom flange portion 51*c* is arranged on the lower end of the outside surface 51*a*, and extends in the width direction. The bottom flange portion 51*c* has an engaging projection 51*f*. The engaging projection 51*f* is provided to one end of the bottom flange portion 51*c* in the width direction. The engaging projection 51*f* projects in the thickness direction.

The first gear part 51*e* is a gear part provided to the upper side surface of the bottom flange portion 51*c*. The first gear part 51*e* has a plurality of gear teeth 51*d* provided to the upper side surface of the bottom flange portion 51*c*. The plurality of gear teeth 51*d* project upwardly from the bottom flange portion 51*c*, and are continuously arranged at predetermined intervals along the width direction.

As illustrated in FIG. 9, the guide portion 53 is a groove provided to an inside surface 51*b* of the first sliding member 51. The guide portion 53 has an entrance portion 53*a*, an inclined portion 53*b*, and a holding portion 53*c*. The entrance portion 53*a* extends upwardly from the lower end of the first sliding member 51 in the height direction. The inclined portion 53*b* extends obliquely in the upper direction from the upper end of the entrance portion 53*a*. The holding portion 53*c* extends in the width direction from the upper end of the inclined portion 53*b*.

As illustrated in FIG. 10, the second sliding member 52 includes a guide portion 54 provided to an inside surface 52*b* thereof, the guide portion 54 being identical with the guide portion 53 of the first sliding member 51. In a state in which the first sliding member 51 and the second sliding member 52 are housed in the housing 2, the guide portion 53 and the guide portion 54 are in plane symmetry with respect to a surface orthogonal to the thickness direction. The guide portion 54 has an entrance portion 54*a*, an inclined portion 54*b*, and a holding portion 54*c* in the same manner as the case of the guide portion 53 of the first sliding member 51.

As illustrated in FIG. 11, an electric wire holding part 7 has a plurality of lead-out ports 71 and a plurality of claw parts 72. The lead-out port 71 is an opening from which an electric wire W connected to the female terminal is led out. The electric wire holding part 7 is engaged with the housing 2 by way of the claw parts 72. The electric wire holding part 7 is inserted into the housing 2 from above in the height direction. The respective claw parts 72 are engaged with the engagement holes 13*b* and 14*b* of the third outer wall portion 13 and the fourth outer wall portion 14 and hence, the electric wire holding part 7 is held by the housing 2.

As illustrated in FIG. 12, the cover 6 has a pair of sidewall portions 61, and a casing portion 62. Each direction illustrated in FIG. 12 is a direction in a state in which the cover 6 is attached to the housing 2. The casing portion 62 covers the upper opening of the housing 2 from above in the height direction. The casing portion 62 connects the upper ends of the sidewall portions 61 with each other. The casing portion 62 includes an engaging claw 62*a* provided to the upper surface thereof. The engaging claw 62*a* is raised upwardly in the height direction. The sidewall portion 61 includes an upper side projection 63 and a lower side projection 64 that are provided to an inside surface 61*a* thereof. Each of the upper side projection 63 and the lower side projection 64 extends in the width direction. The upper side projection 63 and the lower side projection 64 face each other in a spaced-apart manner with a predetermined distance therebetween in the height direction. The projection height of the lower side projection 64 is smaller than the projection height of the upper side projection 63.

The cover 6 is attached to the housing 2 while being slid in the width direction. To be more specific, first of all, the cover 6 is inserted into the housing 2 from above in the height direction, and sandwiches the guide projections 15*c* (16*c*) between the upper side projection 63 and the lower side projection 64 thereof. The lower side projection 64 preferably includes a cutout portion through which the guide projection 15*c* (16*c*) is capable of passing when the cover 6 is attached to the housing 2. The cover 6 is guided by the guide projections 15*c* and 16*c* in the width direction. The sidewall portion 61 includes engaging projections (not illustrated in the drawings) corresponding to the respective recessed portions 15*d* (16*d*) (see FIG. 4), the engaging projections being provided to the inside surface 61*a* of the sidewall portion 61. The cover 6 is fixed to the housing 2 by engaging the engaging projection with the recessed portion 15*d* (16*d*) thus restricting the sliding motion thereof. The cover 6 is, for example, attached to the housing 2 after the completion of attaching the lever 4 and the electric wire W to the housing 2.

Figure 13:
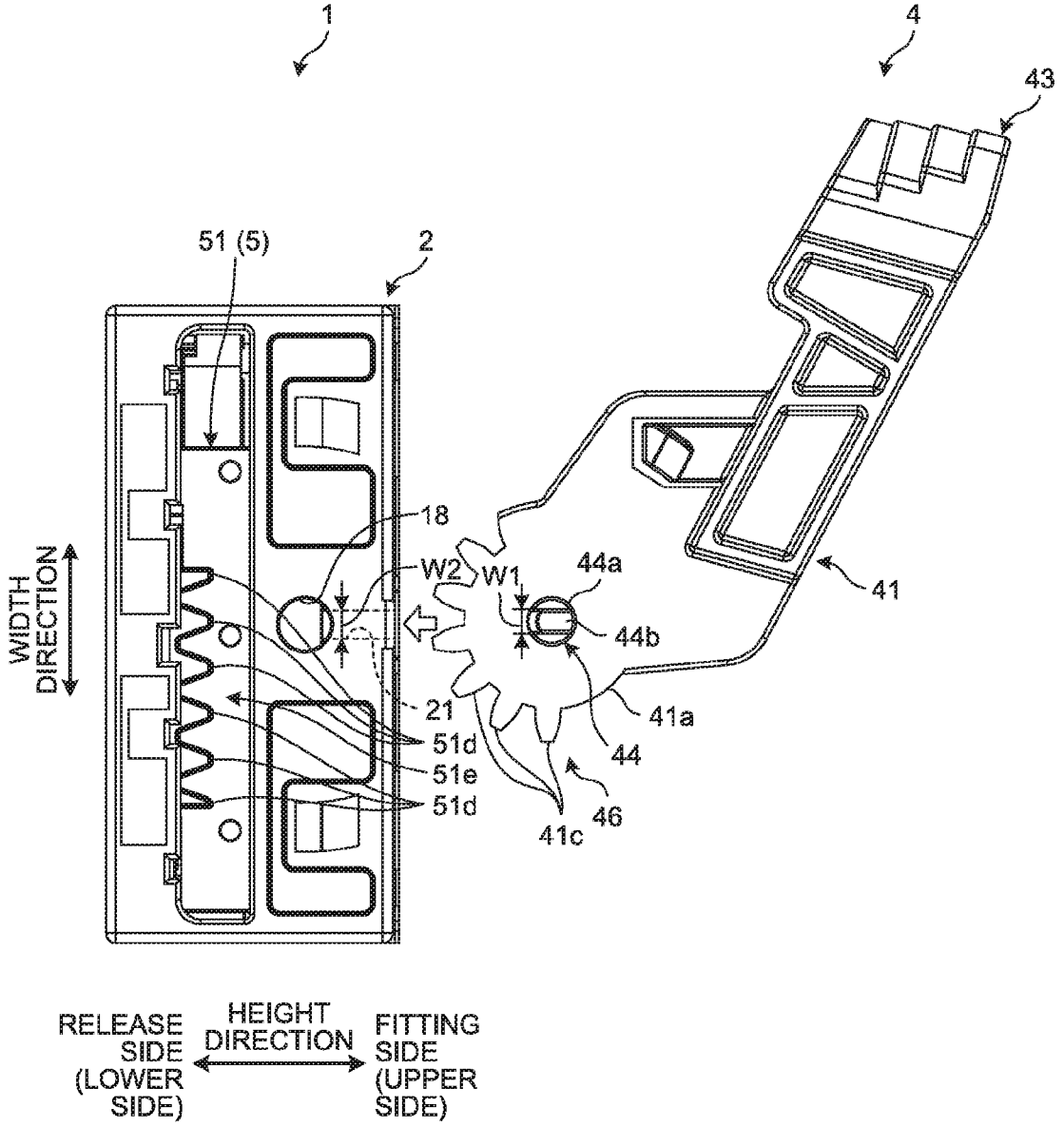
FIG. 13 is a side view for explaining processes of attaching the lever to the housing according to the present embodiment.

FIG. 13 is a side view for explaining processes of attaching the lever to the housing in the present embodiment. As illustrated in FIG. 13, the lever 4 is attached to the housing 2 from above in the height direction. In the present embodiment, the lever 4 is subject to the flexure deformation thus enabling the lever 4 to be inserted into the housing 2. To explain the present embodiment with reference to FIG. 5 and FIG. 7, the distance L1 between the distal ends of the projection portions 44 illustrated in FIG. 7 is smaller than a distance L2 between the grooves 21 illustrated in FIG. 5 thus enabling inserting the lever 4 into the housing 2. The distance L2 between the grooves 21 is a distance from the bottom surface of the groove 21 of the first outer wall portion 11 to the bottom surface of the groove 21 of the second outer wall portion 12 in the thickness direction. The distance L1 between the distal ends of the projection portions 44 when the lever 4 is situated in a free state is larger than the distance L2 between the grooves 21. An assembling worker attaches the lever 4 to the housing 2 while bringing the first plate-like portion 41 and the second plate-like portion 42 of the lever 4 closer to each other so that the lever 4 is subject to the flexure deformation. When the distance L1 between the distal ends of the projection portions 44 is equal to or smaller than the distance L2 between the grooves 21 due to the flexure deformation, the distal-end-side projection portion 44*b* of the first plate-like portion 41 is capable of entering into the groove 21 of the first outer wall portion 11, and the distal-end-side projection portion 44*b* of the second plate-like portion 42 is capable of entering into the groove 21 of the second outer wall portion 12. In this case, the flexure amount of the lever 4 is within the range of an elastic deformation.

As illustrated in FIG. 13, a groove width W2 of the groove 21 is larger than the width W1 of the distal-end-side projection portion 44*b*. Accordingly, the groove 21 allows the distal-end-side projection portion 44*b* to pass therethrough. The size of the groove width W2 is set within the range such that the desired gear tooth 41*c* of the second gear part 46 can be led to the desired tooth space of the first gear part 51*e* so as to prevent the meshing position of the first gear part 51*e* and the second gear part 46 from deviating from a desired meshing position.

Figure 14:
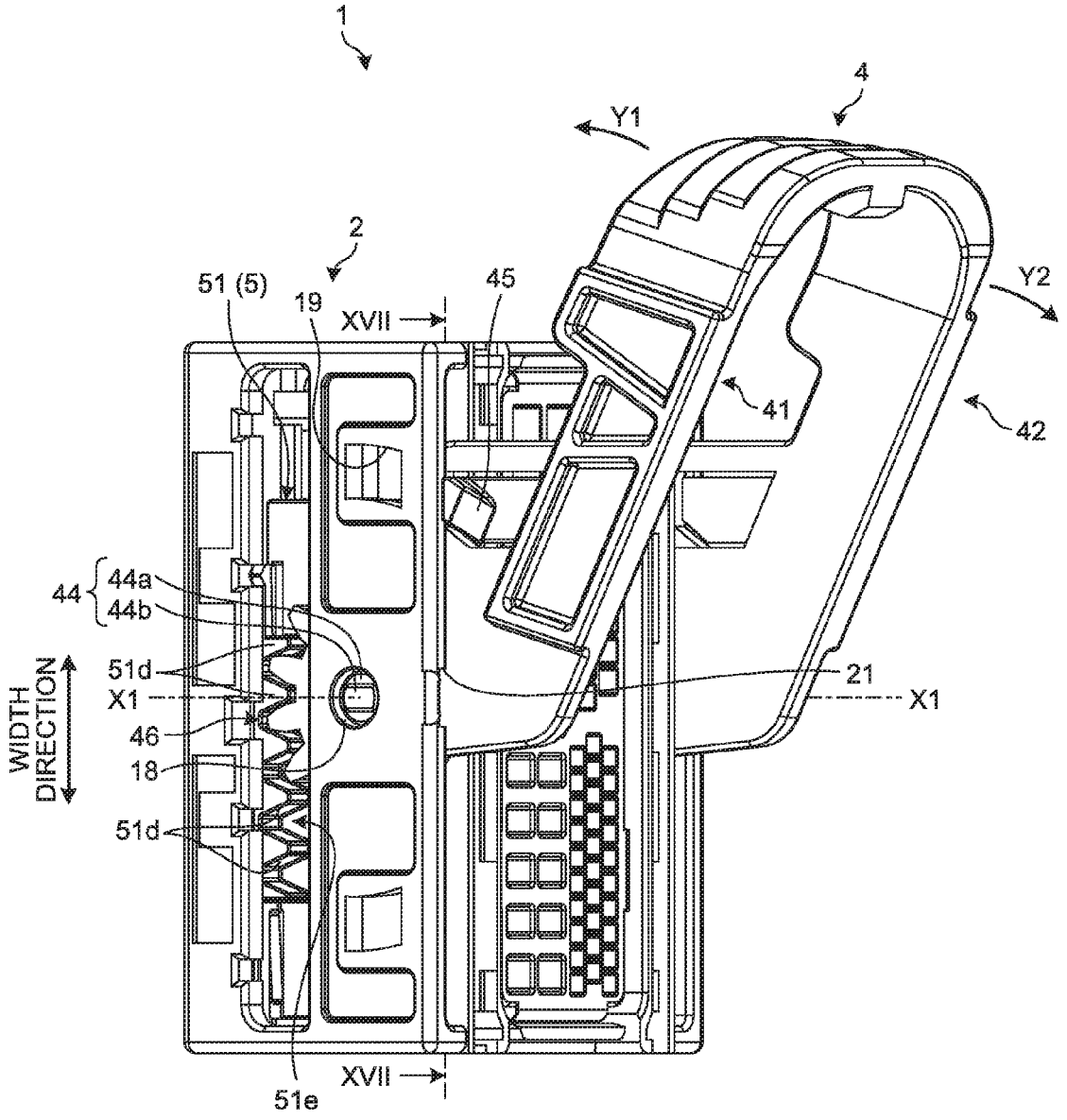
FIG. 14 is a perspective view illustrating a state in which the attachment of the lever to the housing is completed.

FIG. 14 is a perspective view illustrating a state in which the attachment of the lever to the housing is completed. The assembling worker causes two distal-end-side projection portions 44*b* to enter into respective two grooves 21, and to pass through the respective grooves 21 downwardly in the height direction. The assembling worker loosens his/her grip by which the flexure deformation of the lever 4 is caused when two distal-end-side projection portions 44*b* are entered into the respective grooves 21. When the distal-end-side projection portion 44*b* passes through the groove 21 and the projection portion 44 moves to the position corresponding to the support hole 18, the restoring force of the lever 4 causes two projection portions 44 to enter into respective two support holes 18. The inside diameter of the support hole 18 is slightly larger than the outside diameter of the proximal-end-side projection portion 44*a*. Accordingly, the proximal-end-side projection portion 44*a* is, as illustrated in FIG. 14, entered into the support hole 18, and slidably supported by the inner peripheral face of the support hole 18. Two proximal-end-side projection portions 44*a* are supported by respective two support holes 18 and hence, the lever 4 is capable of rotating about the rotational axis X1.

When the projection portion 44 is entered into the support hole 18, as illustrated in FIG. 14, the second gear part 46 of the lever 4 meshes with the first gear part 51*e* of the sliding member 5. When the lever 4 is attached to the housing 2, the sliding member 5 is fixed at a predetermined initial position in the width direction. The position at which the lever 4 is fixed is achieved by engaging the engaging projections 51*f* (see FIG. 8) of the sliding member 5 with the cutout 20*a* (see FIG. 4) of the housing 2. When the lever 4 is attached to the housing 2, before the distal-end-side projection portion 44*b* has passed through the groove 21, the tooth tip of the gear tooth 41*c* of the second gear part 46 enters into a space between the gear teeth 51*d*, which are arranged adjacent to each other, of the first gear part 51*e*. That is, the gear tooth 41*c* determined in advance meshes with a tooth space, which is determined in advance, of the first gear part 51*e*. Namely, while the distal-end-side projection portion 44*b* passes through the groove 21, the rotational position of the lever 4 about the rotational axis X1 is restricted to a predetermined position. Accordingly, while the rotational position of the lever 4 is fixed to the predetermined position, the second gear part 46 is capable of meshing with the first gear part 51*e*. In the following explanation, the position of the lever 4 illustrated in FIG. 14 is referred to as "initial rotation position", wherein the rotational position of the lever 4 is fixed to the predetermined position, the projection portion 44 is engaged with the support hole 18, and the second gear part 46 is meshed with the first gear part 51*e*.

The second gear part 46 is constituted so that the second gear part 46 is meshed with the first gear part 51*e* while the projection portion 44 is engaged with the support hole 18. Accordingly, when the lever 4 is rotated about the rotational axis X1 in a state in which the projection portion 44 is supported by the support hole 18, the sliding member 5 is slid in the width direction depending on the rotation of the lever 4. The gear teeth 41*c* (42*c*) of the second gear part 46 are arranged along the circumferential direction, and the gear teeth 51*d* of the first gear part 51*e* are arranged along a straight line. Due to such a constitution, the rotating motion of the lever 4 is converted into the sliding motion of the sliding member 5 in a meshing portion between the first gear part 51*e* and the second gear part 46.

The lever 4 according to the present embodiment is, as viewed from the direction of the rotational axis X1, constituted so that the plate-like portions 41 and 42 are inclined with respect to the height direction at the initial rotation position of the lever 4. As such a constitution of the lever 4, to be more specific, the longitudinal direction of the distal-end-side projection portion 44*b* is inclined with respect to the extending direction of the plate-like portion 41 (42). The plate-like portion 41 (42) is inclined with respect to the height direction and hence, the lever 4 is prevented from being obstructive in a wire connection process that connects electric wires to the lever-type connector 1.

The lever 4 is rotatable toward both directions about the rotational axis X1 from the initial rotation position illustrated in FIG. 14. That is, the lever 4 is rotatable in both the rotational direction indicated by an arrow Y1 and the rotational direction indicated by an arrow Y2 in FIG. 14, from the initial rotation position. The rotational direction indicated by the arrow Y1 is a rotational direction such that the angle of inclination of the plate-like portion 41 (42) with respect to the height direction is increased.

Figure 15:
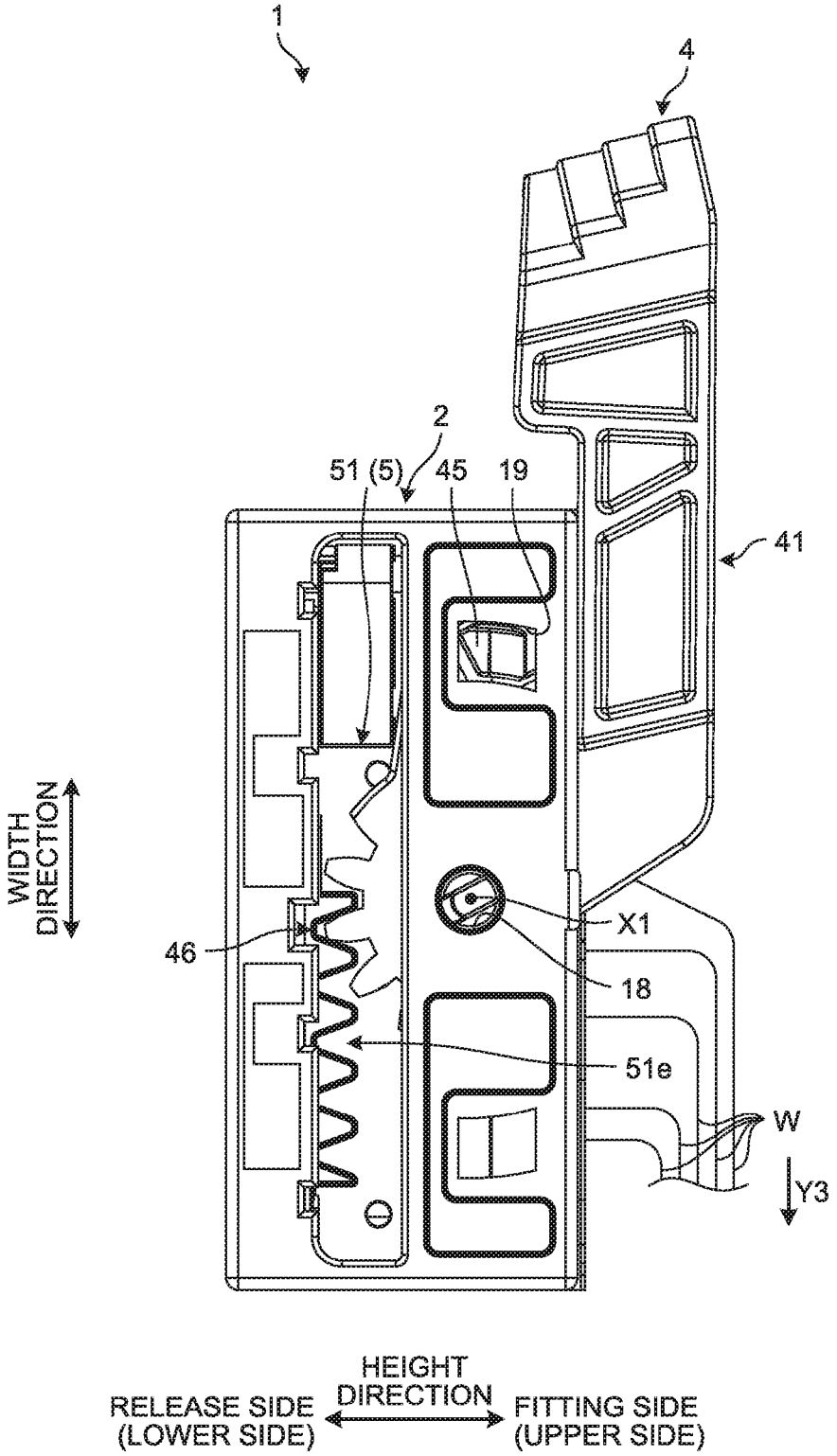
FIG. 15 is a side view illustrating the temporary engaged state of the lever-type connector according to the present embodiment.

FIG. 15 is a side view illustrating the temporary engaged state of the lever-type connector according to the present embodiment. When the lever 4 is rotated in the Y1 direction from the initial rotation position illustrated in FIG. 14, as illustrated in FIG. 15, the engaging claw 45 of the lever 4 is engaged with the temporary engaging hole 19 of the housing 2. Due to such constitution, the rotation of the lever 4 is restricted, and the sliding motion of the sliding member 5 is restricted. The position of the lever 4 illustrated in FIG. 15; that is the position of the lever 4 when the engaging claw 45 is engaged with the temporary engaging hole 19, is referred to as "temporary engagement rotational position."

The wire connection process with respect to the lever-type connector 1 is, for example, performed in a state in which the lever 4 is located at the temporary engagement rotational position. The electric wire W led out from the lever-type connector 1 is drawn out toward a direction indicated by an arrow Y3 illustrated in FIG. 15; that is, a direction opposite to the direction toward the side where the lever 4 is fallen down in the width direction. The wire connection process is completed and thereafter, the cover 6 is attached to the housing 2.

The rotational direction indicated by the arrow Y2 in FIG. 14 is a rotational direction where the angle of inclination of the plate-like portion 41 (42) with respect to the height direction is decreased. When the lever 4 is rotated in the Y2 direction, the plate-like portions 41 and 42 of the lever 4 are rotated about the rotational axis X1 toward the direction orthogonal to the upper surface of the housing 2. In a fitting process explained below, the lever 4 is rotated in the Y2 direction.

Figure 16:
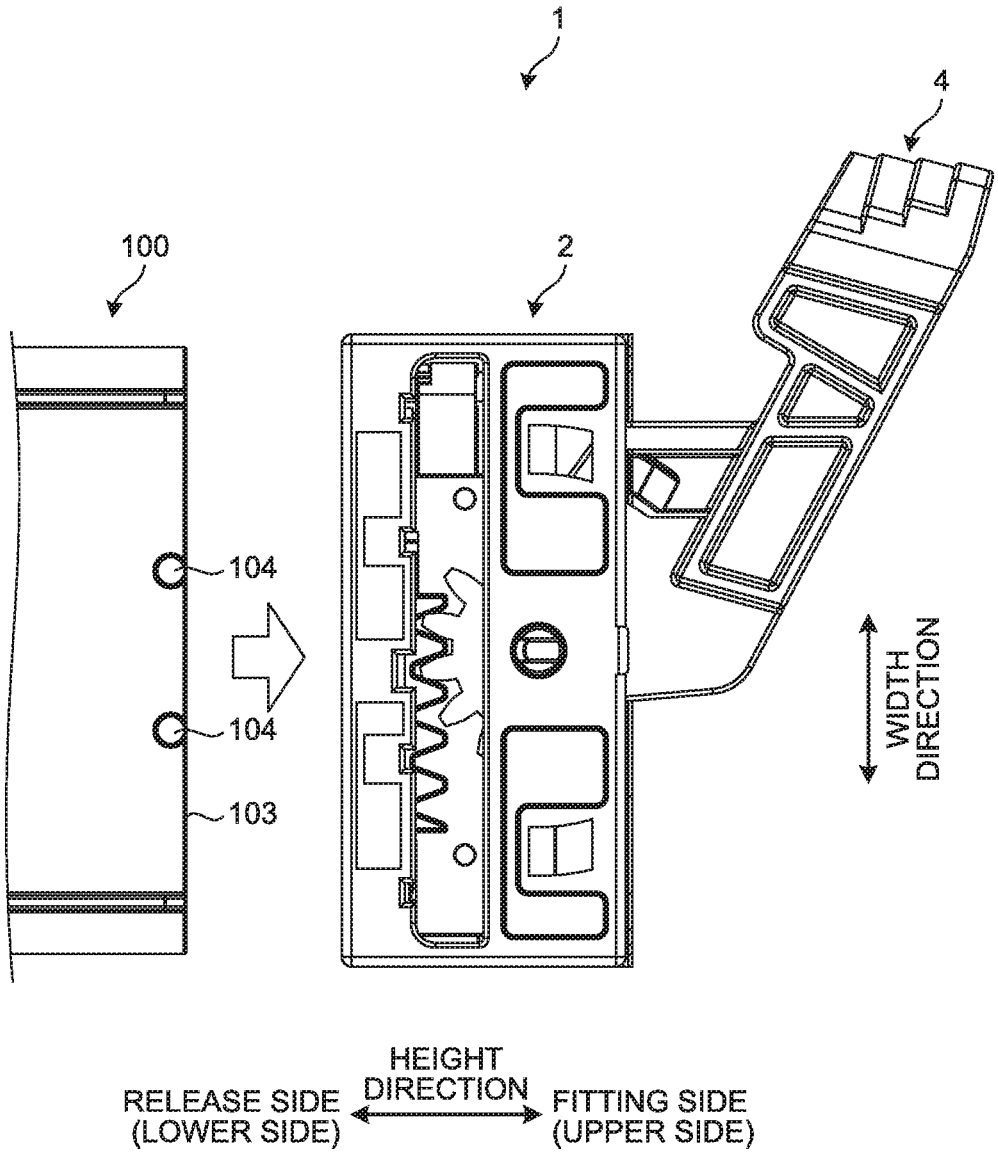
FIG. 16 is a side view for explaining a first fitting process.
Figure 17:
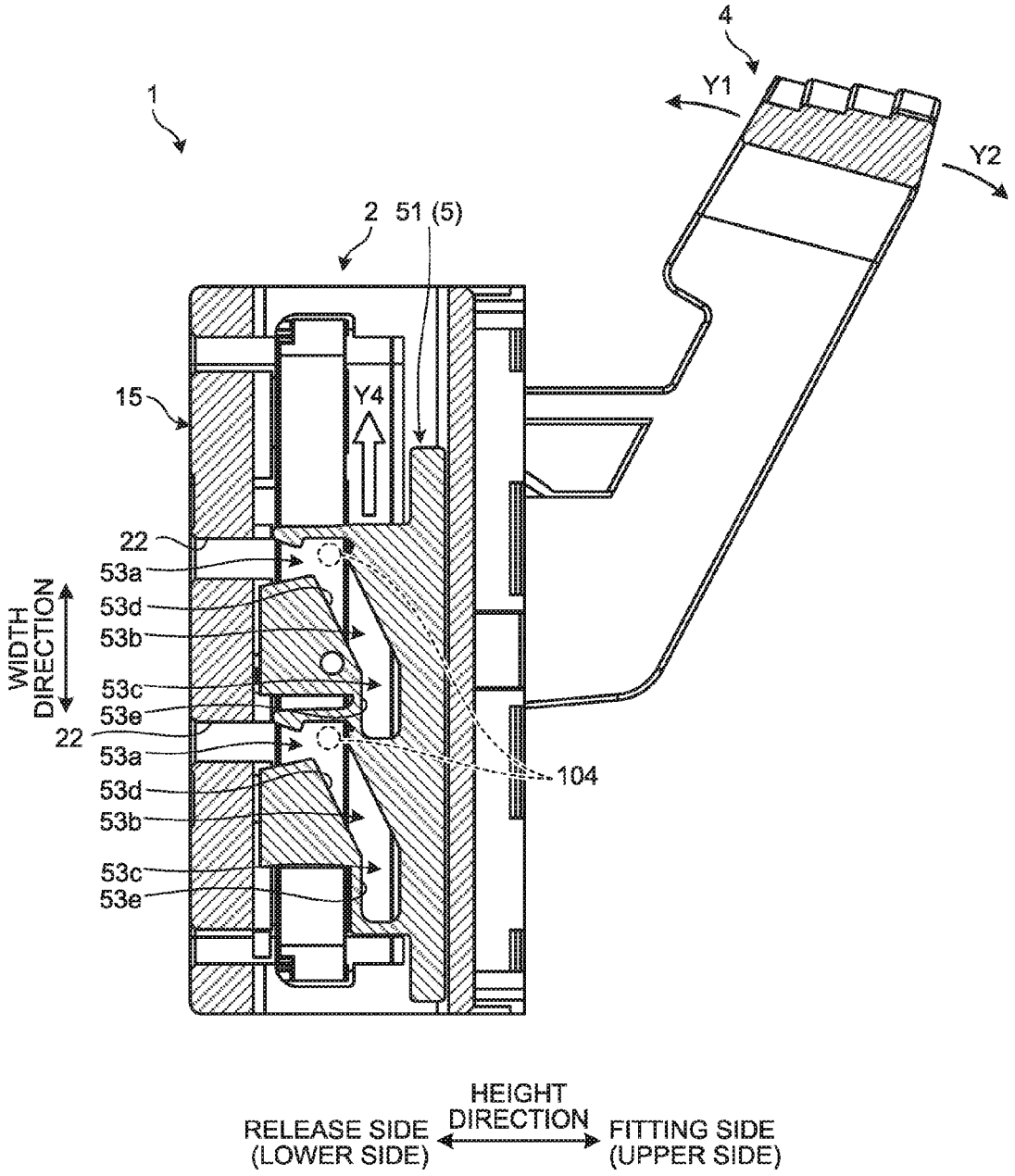
FIG. 17 is a cross-sectional view for explaining a second fitting process.

The fitting process is explained with reference to FIG. 16 and FIG. 17. Here, in FIG. 16 and FIG. 17, although the cover 6 is omitted, the fitting process is actually performed in a state in which the cover 6 is mounted on the housing 2. The fitting process is a process in which the lever-type connector 1 and the counterpart connector 100 are fitted in each other. The fitting process in the present embodiment includes a first fitting process in which the lever-type connector 1 and the counterpart connector 100 are temporarily fitted in each other, and a second fitting process in which the lever-type connector 1 and the counterpart connector 100 are completely fitted in each other. FIG. 16 is a side view for explaining the first fitting process, and FIG. 17 is a cross-sectional view for explaining the second fitting process. FIG. 17 illustrates a cross-sectional view taken along a line XVII-XVII in FIG. 14.

The first fitting process is performed is a state in which the rotational position of the lever 4 is, as illustrated in FIG. 16, located at the initial rotation position. In the first fitting process, the counterpart connector 100 is inserted into the lever-type connector 1 from below in the height direction. When the lever 4 is located at the initial rotation position, the passages 22 of the housing 2 and the respective guide portions 53 (54) of the sliding member 5 are communicated with each other. For example, as illustrated in FIG. 17, the entrance portion 53*a* of the first sliding member 51 opens toward the extension of the passage 22 of the first partition wall 15. Due to such constitution, in the first fitting process, the part to be guided 104 of the counterpart connector 100 enters into the inner side (upper edge) of the entrance portion 53*a* (54*a*) through the passage 22.

The second fitting process is performed in a state in which the part to be guided 104 enters into the inner side of the entrance portion 53*a* (54*a*). In the second fitting process, the assembling worker rotates the lever 4 in the Y2 direction. The sliding member 5 is slid in the direction indicated by an arrow Y4 in FIG. 17 in an interlocking manner with the rotation of the lever 4 in the Y2 direction. Thereafter, in the first sliding member 51, a lower wall surface 53*d* of the inclined portion 53*b* is brought into contact with the part to be guided 104 to depress the part to be guided 104 upwardly (toward the fitting side) in the height direction. That is, the first sliding member 51 is slid depending on the rotation of the lever 4 thus depressing the part to be guided 104 by way of the guide portion 53 thereof. In the same manner as above, the second sliding member 52 is slid depending on the rotation of the lever 4 thus depressing the part to be guided 104 by way of the guide portion 54 thereof. The guide portion 53 (54) depresses the part to be guided 104 thus moving the counterpart connector 100 to the fitting side relative to the lever-type connector 1, and fitting the counterpart connector 100 in the fitting part 3. The guide portion 53 (54) in the present embodiment is constituted so that while the part to be guided 104 is moved to the upper end of the inclined portion 53*b* (54*b*), the male terminal of the counterpart connector 100 and the female terminal of the lever-type connector 1 are electrically contacted with each other.

When the lever 4 is further rotated in the Y2 direction, the part to be guided 104 enters into the holding portion 53*c* (54*c*). The holding portion 53*c* (54*c*) holds the part to be guided 104, and restricts the movement of the part to be guided 104 to the lower side (release side) in the height direction. To explain with reference to FIG. 17, even when the part to be guided 104 is forced to move to the release side, a lower wall surface 53*e* of the holding portion 53*c* is brought into contact with the part to be guided 104, and restricts the movement of the part to be guided 104 to the release side. Due to such constitution, the lever-type connector 1 and the counterpart connector 100 maintain the electrically connected state thereof.

Figure 18:
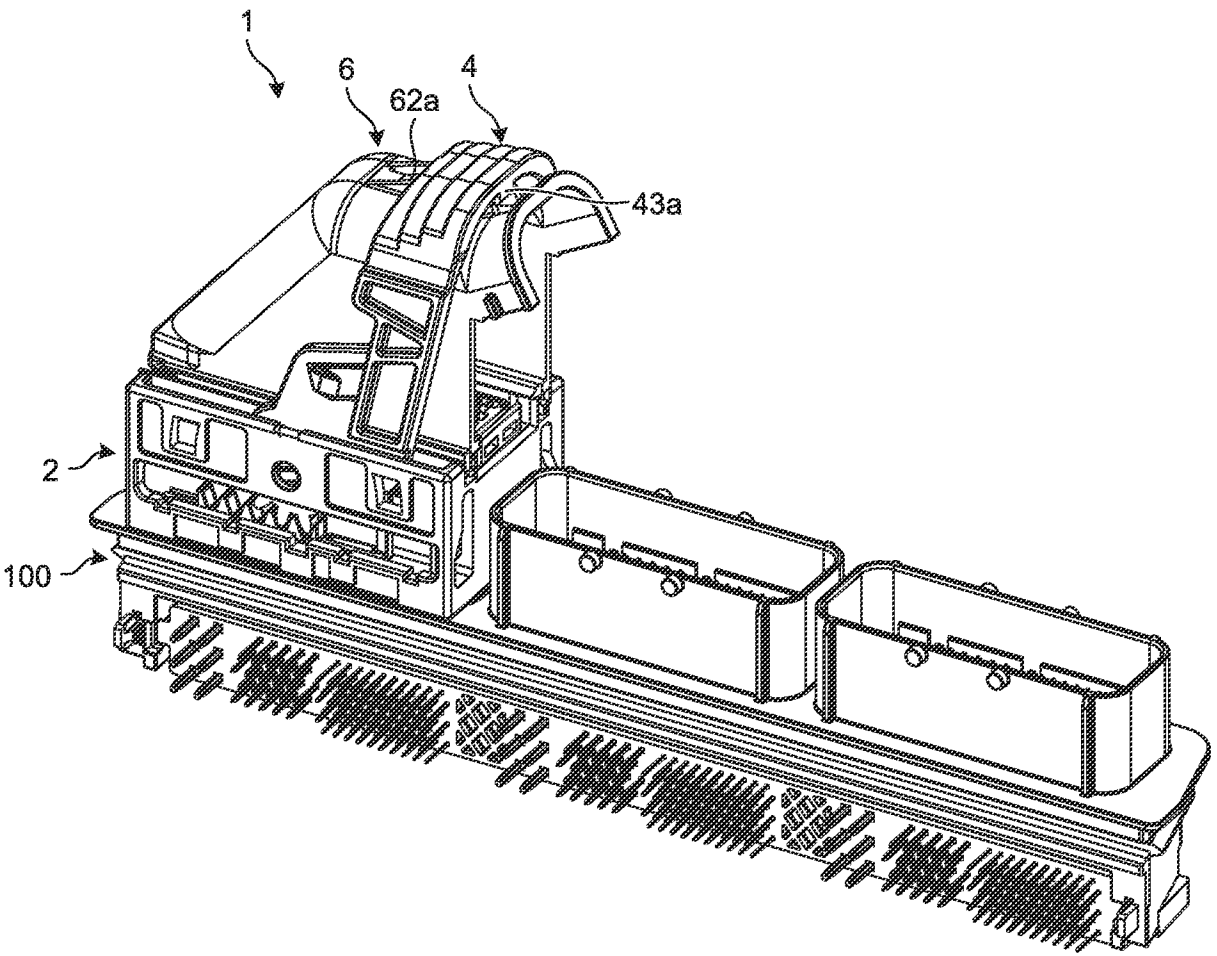
FIG. 18 is a perspective view illustrating the fitting state of the lever-type connector and the counterpart connector in the present embodiment.

FIG. 18 is a perspective view illustrating the fitting state of the lever-type connector and the counterpart connector in the present embodiment. In the second fitting process, as illustrated in FIG. 18, the lever 4 is rotated to the position where the lever 4 is engaged with the cover 6. The engaging projection 43*a* of the lever 4 is engaged with the engaging claw 62*a* of the cover 6 and hence, the lever 4 is locked with respect to the cover 6, and the rotation of the lever 4 is restricted. In a state in which the engaging projection 43*a* is engaged with the engaging claw 62*a*, the part to be guided 104 of the counterpart connector 100 is located in the holding portion 53*c* (54*c*) of the sliding member 5. Accordingly, even when an external force is applied in the direction such that the lever-type connector 1 and the counterpart connector 100 are separated from each other, the holding portion 53*c* (54*c*) is brought into contact with the part to be guided 104 to restrict the relative movement of the counterpart connector 100 thus maintaining the fitting state of the lever-type connector 1 and the counterpart connector 100.

As explained heretofore, the lever-type connector 1 according to the present embodiment has the housing 2, the fitting part 3, the lever 4, and the sliding members 5. The housing 2 has the support holes 18. The fitting part 3 is provided in the inside of the housing 2, and fitted in the counterpart connector 100. The lever 4 has the pair of plate-like portions 41 and 42 that face each other, the connection portion 43 that connects the plate-like portions 41 and 42 with each other, and the projection portions 44 provided to the respective outside surfaces 41*b* and 42*b* of the plate-like portions 41 and 42. The projection portion 44 is engaged with the support hole 18 and hence, the lever 4 is rotatably supported by the housing 2.

The sliding member 5 is slidably supported by the housing 2, and has the guide portions 53 (54) each of which is engaged with the part to be guided 104 provided to the counterpart connector 100. The sliding member 5 is slid depending on the rotation of the lever 4 thus depressing the part to be guided 104 by way of the guide portion 53 (54) thereof to fit the counterpart connector 100 in the fitting part 3. The inside surface 11*a* (12*a*) that constitutes an inside wall surface of the housing 2 has the groove 21 that extends from the edge portion 11*b* (12*b*) of the housing 2 to the support hole 18. The projection portion 44 is allowed to pass through the groove 21 toward the support hole 18 when the rotational position of the lever 4 about the rotational axis X1 is a predetermined position. Due to such constitution, according to the lever-type connector 1 in the present embodiment, the lever 4 can be attached to the housing 2 in a desired posture thus improving the workability in an assembling process. The flexure direction of the lever 4 in inserting the lever 4 into the housing 2 is not a direction such that the plate-like portions 41 and 42 are deflected toward the outside thereof but a direction such that the plate-like portions 41 and 42 are deflected toward the inside thereof. Accordingly, the assembling worker can easily deflect the lever 4 while holding the lever 4.

The projection portion 44 according to the present embodiment has the proximal-end-side projection portion 44*a* that projects from the outside surface 41*b* (42*b*) of the plate-like portion 41 (42), and formed in a circular shape as viewed in a cross-sectional view orthogonal to the rotational axis X1 of the lever 4; and the distal-end-side projection portion 44*b* that projects from the proximal-end-side projection portion 44*a*, and formed in a belt shape as viewed in a cross-sectional view orthogonal to the rotational axis X1. The groove 21 allows the distal-end-side projection portion 44*b* to pass therethrough when the rotational position of the lever 4 about the rotational axis X1 is a predetermined position. The distal-end-side projection portion 44*b* formed in a belt shape as viewed in a cross-sectional view and the groove 21 restrict the rotational position of the lever 4 in assembling thus improving the workability in the assembling process. Furthermore, not only the proximal-end-side projection portion 44*a* but also the distal-end-side projection portion 44*b* is inserted into the support hole 18 thus improving the effect of preventing the projection portion 44 from being released from the support hole 18.

Furthermore, the sliding member 5 in the present embodiment has the first gear part 51*e* including the plurality of gear teeth 51*d* continuously arranged along the sliding direction of the sliding member 5. The lever 4 has the second gear part 46 that is provided to the end portion opposite to the connection portion 43 side of the plate-like portion 41 (42), and meshed with the first gear part 51*e*. The rotating motion of the lever 4 is converted into the sliding motion of the sliding member 5 in a meshing portion between the first gear part 51*e* and the second gear part 46. In the lever-type connector 1 according to the present embodiment, the rotational position of the lever 4 in attaching the lever 4 to the housing 2 is restricted to the predetermined position thus restricting the displacement of the meshing position of the first gear part 51*e* and the second gear part 46. Accordingly, the workability in attaching the lever-type connector 1 to the counterpart connector 100 is improved.

First Modification of Embodiment

A first modification in the embodiment is explained. In contrast with the lever 4 of the above-mentioned embodiment, the distal-end-side projection portion 44*b* may be provided only to one of two projection portions 44. Even when the number of the distal-end-side projection portions 44*b* is one, it is possible to restrict the direction of the lever 4 in attaching the lever 4 to the housing 2; that is, it is possible to restrict the posture (rotational position) of the lever 4 in attaching the lever 4 to the housing 2 to a desired posture.

When the distal-end-side projection portion 44*b* is provided only to one of the projection portions 44, the groove 21 may be further formed only on one of the first outer wall portion 11 and the second outer wall portion 12 of the housing 2. Due to such constitution, erroneous attachment of the lever 4 to the housing 2 is suppressed. When the lever 4 is attached to the housing 2 in a horizontally inverted posture, the outer wall portion 11 (12) to which the groove 21 is not provided restricts the passage of the distal-end-side projection portion 44*b* thus preventing the erroneous attachment of the lever 4.

Second Modification of Embodiment

The shape of the distal-end-side projection portion 44*b* is not limited to the shape exemplified in the embodiment. For example, the width W1 of the distal-end-side projection portion 44*b* may be nonuniform. Any shape of the distal-end-side projection portion 44*b* can be adopted provided that the shape is such that the rotational position of the lever 4 can be restricted in a predetermined position, or in a predetermined range when the distal-end-side projection portion 44*b* is engaged with the groove 21.

In the above-mentioned embodiment, each of the guide portions 53 and 54 of the sliding member 5 is a groove, and the part to be guided 104 of the counterpart connector 100 is a projection portion. However, in contrast with above, each of the guide portions 53 and 54 may be a projection portion, and the part to be guided 104 may be a groove.

The contents disclosed in the above-mentioned embodiment and modifications can be brought into practice by optionally combining the embodiment and the modifications with each other.

The lever-type connector according to the present embodiment includes a housing having support holes; a fitting part that is provided inside the housing and fitted in a counterpart connector; a lever having a pair of plate-like portions facing each other in an opposed manner, a connection portion that connects the pair of plate-like portions with each other, and projection portions provided respective outside surfaces of the plate-like portions, the lever being rotatably supported by the housing while the projection portions are engaged with the support holes; and sliding members each having a guide portion that is slidably supported by the housing and engaged with a part to be guided provided to the counterpart connector, the sliding members being slid depending on the rotation of the lever to depress the part to be guided by way of the guide portion and fit the counterpart connector in the fitting part.

The inside wall surface of the housing has grooves each extending from the edge of the housing to the support holes. The projection portions are allowed to pass through the grooves toward the support holes when the rotational position of the lever about a rotation axis is a predetermined position. In the lever-type connector according to the present embodiment, it is possible to achieve an advantageous effect of attaching the lever to the housing in a state in which the rotational position of the lever is the predetermined position thus improving the workability in the assembling processes.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A lever-type connector comprising:

a housing having support holes;

a fitting part provided inside the housing and fitted in a counterpart connector;

a lever that includes a pair of plate-like portions facing each other in an opposed manner, a connection portion connecting the pair of plate-like portions with each other, and projection portions provided respective outside surfaces of the pair of plate-like portions, the lever being rotatably supported by the housing while the projection portions are engaged with the support holes; and sliding members each includes a guide portion that is slidably supported by the housing and engaged with a part to be guided provided to the counterpart connector, the sliding members being slid depending on a rotation of the lever to depress the part to be guided by way of the guide portion and fit the counterpart connector in the fitting part, wherein an inside wall surface of the housing has grooves each extending from an edge portion of the housing to the support holes, and the projection portions are allowed to pass through the grooves toward the support holes when a rotational position of the lever about a rotational axis of the lever is a predetermined position.

2. The lever-type connector according to claim 1, wherein the projection portions each includes a proximal-end-side projection portion projecting from the outside surface of each of the pair of plate-like portions and formed in a circular shape as viewed in a cross-sectional view orthogonal to the rotational axis of the lever, and a distal-end-side projection portion projecting from the proximal-end-side projection portion and formed in a belt shape as viewed in a cross sectional view orthogonal to the rotational axis, and the grooves allow the distal-end-side projection portion to pass therethrough when the rotational position about the rotational axis of the lever is the predetermined position.

3. The lever-type connector according to claim 1, wherein the sliding members each includes a first gear part including a plurality of gear teeth continuously arranged along a sliding direction of the sliding members, the lever includes a second gear part provided to an end portion opposite to the connection portion in the plate-like portions and meshed with the first gear part, and rotating motion of the lever is converted into sliding motion of the sliding members in a meshing portion between the first gear part and the second gear part.

4. The lever-type connector according to claim 2, wherein the sliding members each includes a first gear part including a plurality of gear teeth continuously arranged along a sliding direction of the sliding members, the lever includes a second gear part provided to an end portion opposite to the connection portion in the plate-like portions and meshed with the first gear part, and rotating motion of the lever is converted into sliding motion of the sliding members in a meshing portion between the first gear part and the second gear part.

* * * * *